US012133577B2

(12) United States Patent
Tsuda et al.

(10) Patent No.: US 12,133,577 B2
(45) Date of Patent: Nov. 5, 2024

(54) BUCKLE DEVICE

(71) Applicant: ASHIMORI INDUSTRY CO., LTD., Settsu (JP)

(72) Inventors: Hiroshi Tsuda, Settsu (JP); Shigehiko Kubo, Settsu (JP); Takao Ishizaki, Settsu (JP); Kazuki Umebayashi, Settsu (JP)

(73) Assignee: ASHIMORI INDUSTRY CO., LTD., Settsu (JP)

( * ) Notice: Subject to any disclaimer, the term of this patent is extended or adjusted under 35 U.S.C. 154(b) by 0 days.

(21) Appl. No.: 18/163,083

(22) Filed: Feb. 1, 2023

(65) Prior Publication Data

US 2023/0248121 A1 Aug. 10, 2023

(30) Foreign Application Priority Data

Feb. 4, 2022 (JP) ..... 2022-016297

(51) Int. Cl.
*A44B 11/25* (2006.01)

(52) U.S. Cl.
CPC ..... *A44B 11/2523* (2013.01); *Y10T 24/45665* (2015.01)

(58) Field of Classification Search
CPC ..... Y10T 24/45644; Y10T 24/45665; Y10T 24/45623; A44B 11/2523
See application file for complete search history.

(56) References Cited

U.S. PATENT DOCUMENTS

| | | | | |
|---|---|---|---|---|
| 5,555,609 | A | 9/1996 | Tolfsen et al. | |
| 6,367,129 | B1 * | 4/2002 | Mori | A44B 11/2523 24/641 |
| 7,543,363 | B2 * | 6/2009 | Webber | A44B 11/2523 24/641 |
| 9,402,446 | B2 * | 8/2016 | Haas | B60R 99/00 |
| 2005/0086777 | A1 * | 4/2005 | Kawai | A44B 11/2523 24/633 |
| 2005/0257354 | A1 * | 11/2005 | Kawai | A44B 11/2523 24/641 |

FOREIGN PATENT DOCUMENTS

| | | | | |
|---|---|---|---|---|
| DE | 92 02 526 U1 | | 4/1992 | |
| GB | 2271377 A | * | 4/1994 | A44B 11/2523 |
| JP | 7-505557 A | | 6/1995 | |
| JP | 4609922 B2 | | 1/2011 | |
| WO | WO-2011052415 A1 | * | 5/2011 | A44B 11/2523 |

* cited by examiner

*Primary Examiner* — Robert Sandy
*Assistant Examiner* — Michael S Lee
(74) *Attorney, Agent, or Firm* — Sughrue Mion, PLLC

(57) ABSTRACT

A buckle device into which a tongue plate provided on a seat belt of a vehicle is to be inserted, and which detachably engages with the inserted tongue plate. The buckle device includes a hollow buckle body, an operating member configured to be operated in response to a release operation for releasing engagement between the tongue plate and the buckle device, the operating member being supported, in the buckle body, to be slidable in an insertion direction of the tongue plate, and an inertia member supported, in the buckle body, to be rotatable about a rotation center axis extending in a width direction of the tongue plate.

7 Claims, 20 Drawing Sheets

BUCKLE DEVICE

CROSS-REFERENCE TO RELATED APPLICATIONS

This application is based on and claims priority under 35 USC § 119 from Japanese Patent Application No. 2022-016297 filed on Feb. 4, 2022, the contents of which are incorporated herein by reference.

TECHNICAL FIELD

The present disclosure relates to a buckle device that is a component of a seat belt device of a vehicle.

BACKGROUND ART

In the related art, there has been known a buckle device into which a tongue plate provided on a seat belt (also referred to as webbing) of a vehicle is to be inserted, and which detachably engages with the inserted tongue plate. For example, German Utility Model Publication No. 9202526 discloses a buckle device 100, which is shown in FIG. 15A, that prevents engagement of a tongue plate 110 from being released by an inertial force.

Specifically, in the buckle device 100 disclosed in German Utility Model Publication No. 9202526, a mechanical assembly 120 is disposed in a hollow buckle body that is not shown. The mechanical assembly 120 includes a release button 130 configured to receive a release operation for releasing the engagement of the tongue plate 110, and an inertia member 140.

The inertia member 140 is configured to rotate about a rotation center axis 150. As shown in FIG. 15B, a slot 131, which is opened in a thickness direction of the tongue plate 110, is provided in a portion, located between the rotation center axis 150 of the inertia member 140 and the tongue plate 110, of the release button 130. The inertia member 140 includes a lever 141 protruding from the rotation center axis 150 toward the slot 131, and a distal end of the lever 141 is inserted into the slot 131. The center of gravity of the inertia member 140 is provided on a side opposite to the lever 141 with respect to the rotation center axis 150.

In an engaged state of the tongue plate 110, in a case where an inertial force in the A direction acts on the release button 130, in which the inertial force caused by an acceleration in a B direction, which is opposite to an A direction that is an insertion direction of the tongue plate 110, is generated in the buckle device 100, the inertial force in the A direction also acts on the inertia member 140, and a torque around the rotation center axis 150 is generated in the inertia member 140. Therefore, the release button 130 is pressed in the B direction by the lever 141 of the inertia member 140. The inertia member 140 is configured such that a pressing force at this time becomes larger than the inertial force of the release button 130, and thus, the inertia member 140 prevents the release button 130 from operating in a case where the inertial force in the A direction acts on the release button 130.

However, in the buckle device 100 of German Utility Model Publication No. 9202526, even in a case where the inertial force in the B direction acts on the release button 130, the lever 141 of the inertia member 140 presses the release button 130 in the A direction with the pressing force larger than the inertial force of the release button 130, and thus, the release button 130 may be operated by the inertia member 140.

SUMMARY OF INVENTION

Accordingly, an object of the present disclosure is to provide a buckle device capable of reliably preventing engagement of a tongue plate from being released by an inertial force, regardless of a direction of the inertial force.

The present disclosure provides a buckle device into which a tongue plate provided on a seat belt of a vehicle is to be inserted, and for detachably engaging with the inserted tongue plate, the buckle device including:

a hollow buckle body;

an operating member configured to be operated in response to a release operation for releasing engagement between the tongue plate and the buckle device, the operating member being supported, in the buckle body, to be slidable in an insertion direction of the tongue plate; and an inertia member supported, in the buckle body, to be rotatable about a rotation center axis extending in a width direction of the tongue plate, in which the inertia member includes:

a main body portion through which the rotation center axis penetrates; and a first lever and a second lever protruding from the main body portion in a direction away from the rotation center axis, the first lever and the second lever being arranged at a predetermined interval in the insertion direction of the tongue plate when viewed from an extending direction of the rotation center axis, the first lever is located on an inner side, than the second lever, of the buckle body in the insertion direction of the tongue plate, in an engaged state of the tongue plate, the operating member is configured to be in contact, at a first contact portion, with the first lever and configured to be in contact, at a second contact portion, with the second lever, the engaged state of the tongue plate being a state where the tongue plate is engaged with the buckle body, in the engaged state of the tongue plate, the first contact portion and the second contact portion are located between the first lever and the second lever in the insertion direction of the tongue plate, in a case where the tongue plate is disengaged from the buckle body, the first contact portion and the second contact portion move in a direction away from a position between the first lever and the second lever, in accordance with a rotation of the inertia member, in a case where a first inertial force in the insertion direction of the tongue plate acts on the operating member in the engaged state of the tongue plate, the first lever applies, to the first contact portion, a first pressing force in a direction opposite to the insertion direction of the tongue plate, the first pressing force being larger than the first inertial force, and in a case where a second inertial force in the direction opposite to the insertion direction of the tongue plate acts on the operating member in the engaged state of the tongue plate, the second lever applies, to the second contact portion, a second pressing force in the insertion direction of the tongue plate, the second pressing force being smaller than the second inertial force.

According to the above configuration, in a case where the first inertial force in the insertion direction of the tongue plate acts on the operating member, the first pressing force, which is larger than the first inertial force, in the direction opposite to the first inertial force is applied from the first lever of the inertia member to the operating member, and thus, the operating member is prevented from being operated. On the other hand, in a case where the second inertial force in the direction opposite to the insertion direction of the tongue plate acts on the operating member, the second pressing force in the direction opposite to the second inertial force is applied from the second lever of the inertia member to the operating member. However, the second pressing force is smaller than the second inertial force, and thus, the operating member is not operated in the insertion direction of the tongue plate by the second lever. Therefore, the engagement of the tongue plate can be reliably prevented from being released by an inertial force, regardless of a direction of the inertial force. In addition, since the first contact portion and the first lever of the first inertial force are provided separately from the second contact portion and the second lever of the second inertial force, the degree of freedom in design is high.

In a thickness direction of the tongue plate, a first distance may be smaller than a second distance, the first distance being a distance from the rotation center axis of the inertia member to a contact point between the first contact portion and the first lever, the second distance being a distance from the rotation center axis of the inertia member to a contact point between the second contact portion and the second lever. Alternatively, in the engaged state of the tongue plate, a first angle may be larger than a second angle, the first angle being formed by the insertion direction of the tongue plate and a surface, which is at a side of the first contact portion, of the first lever, the second angle being formed by the direction opposite to the insertion direction of the tongue plate and a surface, which is at a side of the second contact portion, of the second lever.

According to these configurations, it is possible to provide a difference between the first pressing force and the second pressing force with a relatively simple configuration.

The buckle device further includes: a release button configured to receive the release operation; an engagement member configured to engage with the tongue plate that is to be inserted into the buckle body; and a lock member, in which, in a case where the engagement member engages with the tongue plate, the lock member is configured to be operated in a lock direction to prevent engagement between the engagement member and the tongue plate from being released, in a case where the release button is operated toward an inner side of the buckle body, the lock member is configured to be operated in a direction opposite to the lock direction to enable the engagement between the engagement member and the tongue plate to be released, and the operating member is at least one of the release button or the lock member. According to this configuration, the buckle device generally includes the release button and the lock member, and thus, the first contact portion and the second contact portion can be provided without adding components.

The operating member may be both the release button and the lock member, the first contact portion may be provided on the lock member, and the second contact portion may be provided on the release button.

According to this configuration, it is possible to simplify the shape of the release button and the shape of the lock member to easily manufacture the release button and the lock member, or to easily provide the release button and the lock member in consideration of the strength and the shape of other members.

The release button is biased in the direction opposite to the insertion direction of the tongue plate, and in a state where the tongue plate is not inserted into the buckle body, the first lever is configured to be in contact with the lock member, and the second lever is configured to be in contact with the release button.

According to this configuration, in a disengaged state of the tongue plate, the movement of the release button and the rotation of the inertia member are prevented, and thus it is possible to prevent abnormal noise due to rattling of the release button and the inertia member.

In the engaged state of the tongue plate, the first lever and the second lever are located on a side opposite to the tongue plate with respect to the rotation center axis. According to this configuration, the shapes and sizes of the first lever, the second lever, the first contact portion, and the second contact portion are less likely to be limited by a space of the tongue plate.

According to the present disclosure, engagement of a tongue plate can be reliably prevented from being released by an inertial force, regardless of a direction of the inertial force.

DESCRIPTION OF EMBODIMENTS

Figure 1A:
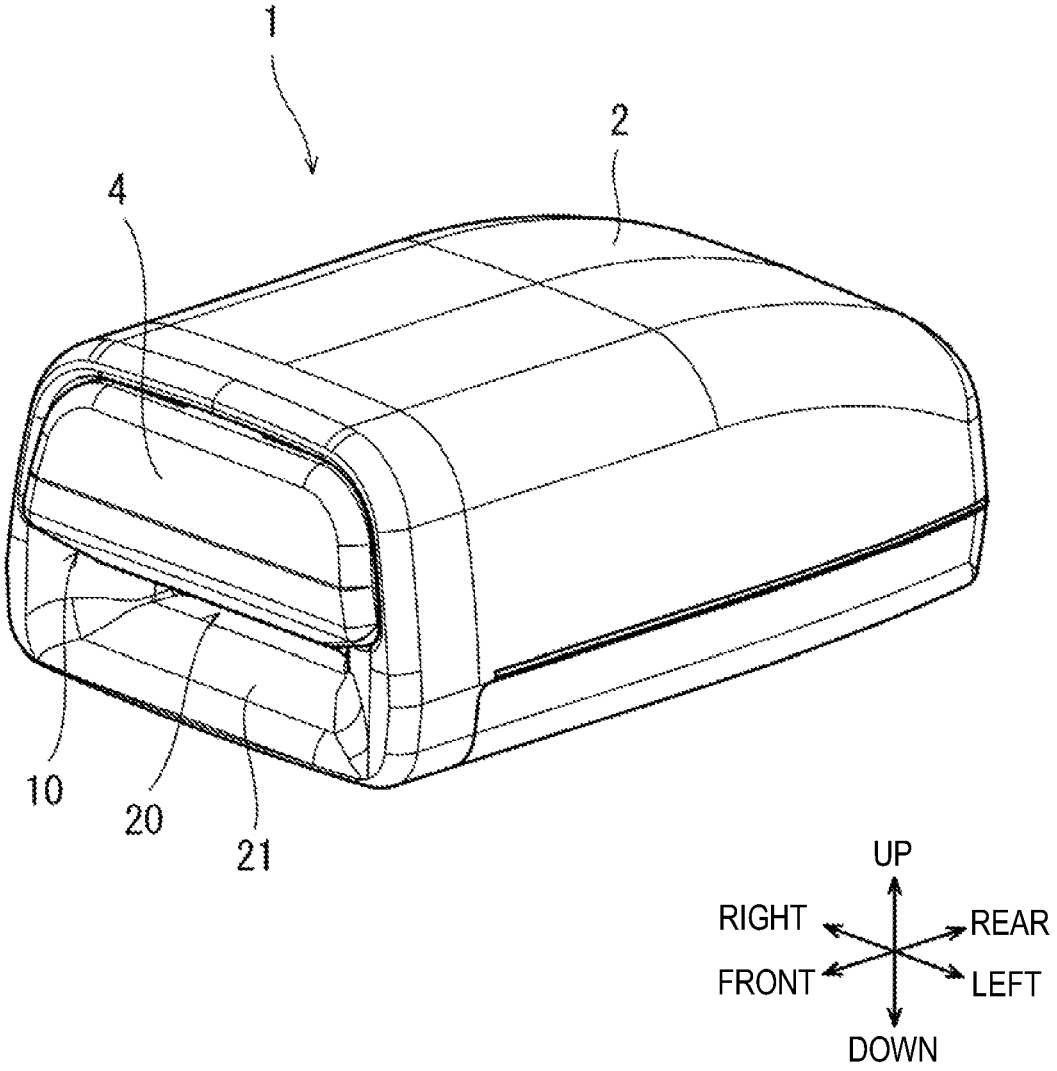
FIG. 1A is a perspective view of a buckle device according to an embodiment of the present disclosure.
Figure 1B:
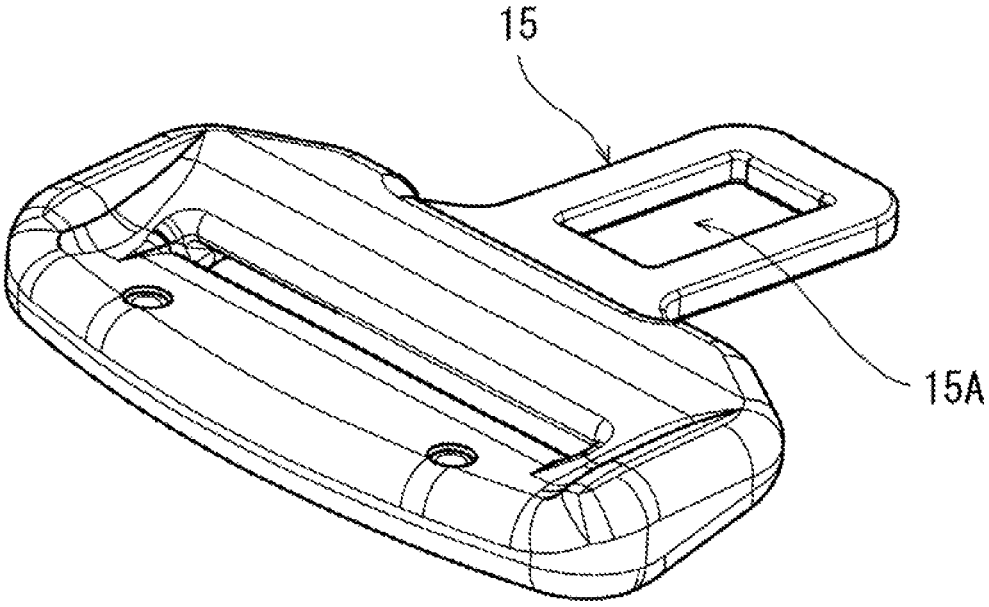
FIG. 1B is a perspective view of a tongue plate.

FIG. 1A shows a buckle device 1 according to an embodiment of the present disclosure. The buckle device 1 is a device into which a tongue plate 15, shown in FIG. 1B, that is provided on a seat belt of a vehicle is to be inserted, and which detachably engages with the inserted tongue plate 15.

Figure 2:
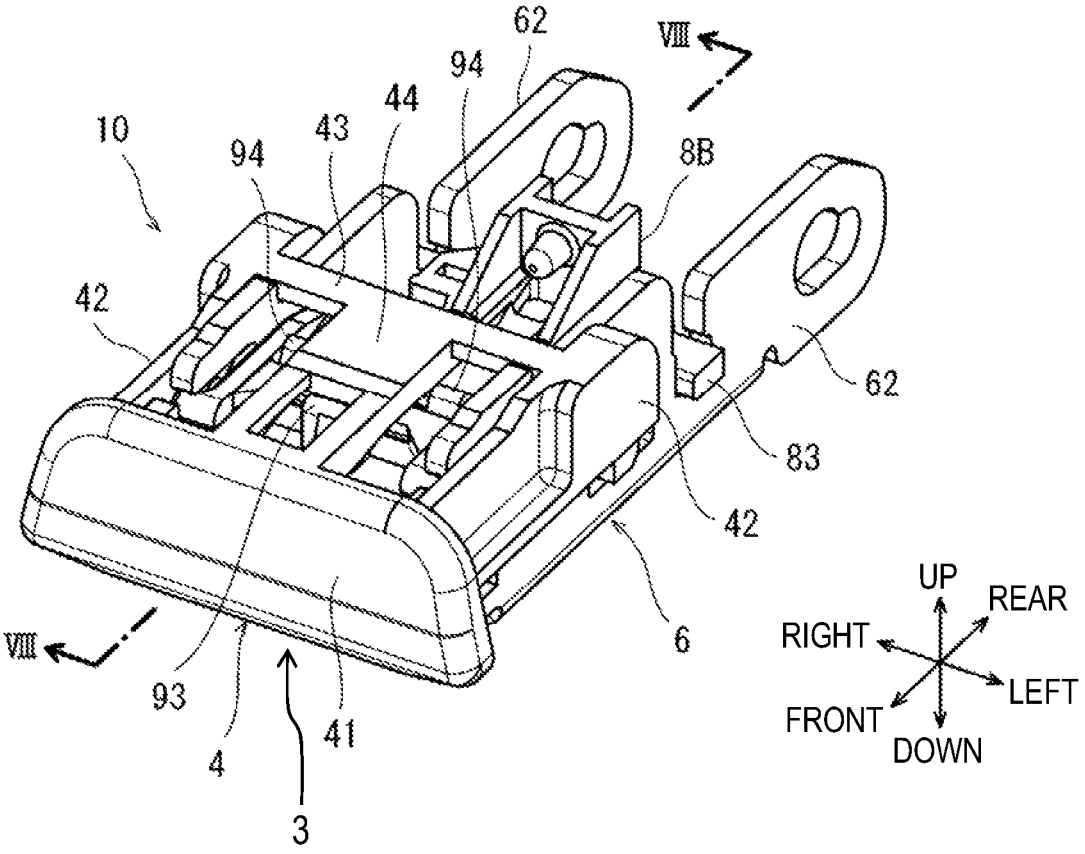
FIG. 2 is a perspective view of a mechanical assembly disposed in a buckle body of the buckle device of FIG. 1.

Specifically, the buckle device 1 includes a hollow buckle body 2 and a mechanical assembly 10, shown in FIG. 2, that is disposed in the buckle body 2. That is, the buckle body 2 serves as a cover configured to accommodate the mechanical assembly 10.

Hereinafter, for convenience of explanation, an insertion direction of the tongue plate 15 is referred to as the rear, and a direction opposite to the insertion direction of the tongue plate 15 is referred to as the front. One side, in a thickness direction, of the tongue plate 15 is referred to as an upper side, the other side is referred to as a lower side, and a width direction of the tongue plate 15 is referred to as a left-right direction.

The mechanical assembly 10 includes a frame 6 and an operating member 3. The frame 6 has a groove shape having a U-shape, which extends in a front-rear direction and opens upward, in a cross sectional view. The operating member 3 is supported by the frame 6 to be slidable in the front-rear direction. The operating member 3 is operated in response to a release operation for releasing engagement of the tongue plate 15.

Figure 3:
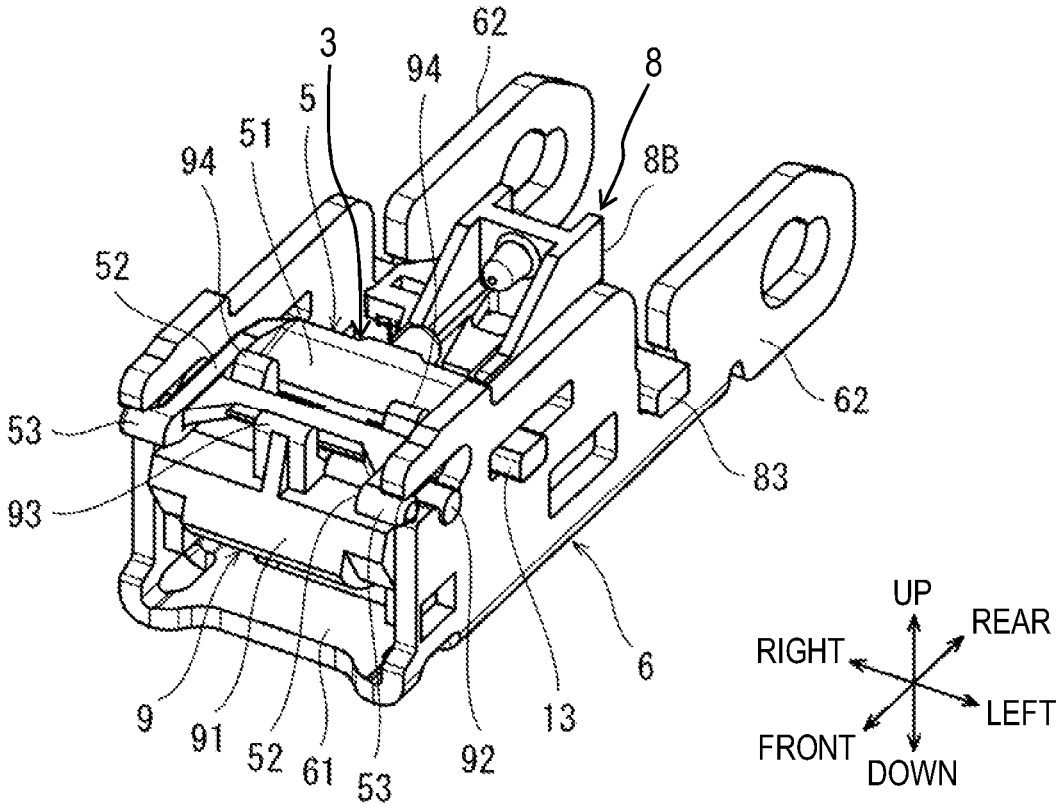
FIG. 3 is a perspective view of the mechanical assembly with a release button removed.

In the present embodiment, the operating member 3 includes both a release button 4 and a lock member 5 (see FIG. 3). FIG. 3 is a perspective view of the mechanical assembly 10 with the release button 4 removed, in an engaged state of the tongue plate 15 (the tongue plate 15 is omitted). The release button 4 is configured to receive the release operation. The lock member 5 is configured to maintain an engaged state of the tongue plate 15 shown in FIG. 9C.

As shown in FIG. 1A, the buckle body 2 has a front opening, which is opened forward, having substantially rectangular shape that is long in the left-right direction. The release button 4 closes an upper portion of the front opening. A portion, located below the front opening, of the buckle body 2 is a tongue plate guiding portion 21 that is inclined obliquely upward toward the rear and then becomes parallel to the front-rear direction. A tongue plate insertion opening 20 is formed between the tongue plate guiding portion 21 and the release button 4.

Figure 4:
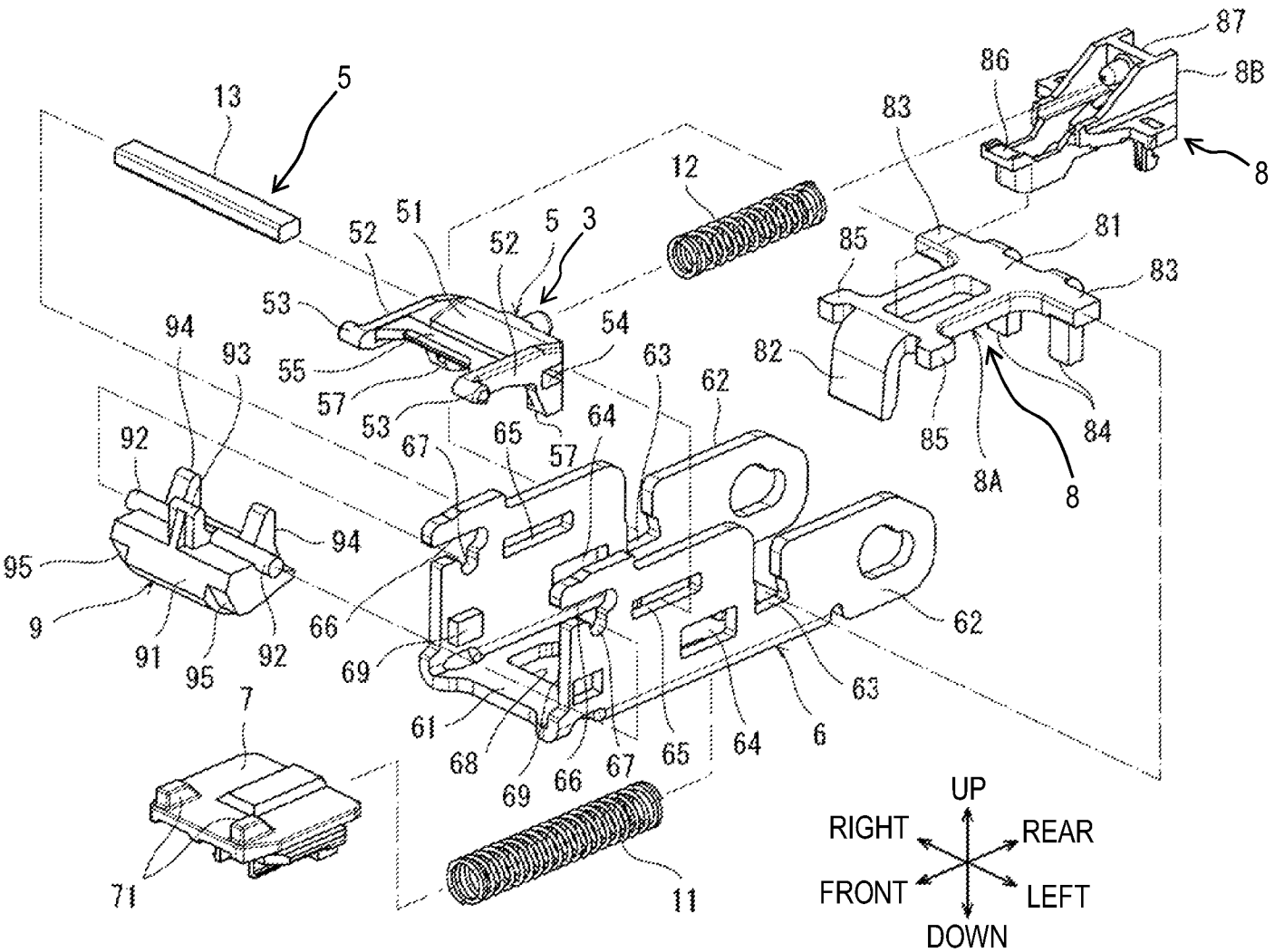
FIG. 4 is an exploded perspective view of the mechanical assembly other than the release button.

As shown in FIGS. 3 and 4, the mechanical assembly 10 includes an ejector 7, an engagement member 8, and an inertia member 9 in addition to the frame 6 and the operating member 3. The ejector 7 abuts the tongue plate 15 inserted into the buckle body 2 through the tongue plate insertion opening 20. The engagement member 8 engages with the tongue plate 15 inserted into the buckle body 2 through the tongue plate insertion opening 20. The inertia member 9 prevents the operating member 3 from being operated due to an inertial force, in the engaged state of the tongue plate 15.

More specifically, as shown in FIG. 4, the frame 6 has a bottom wall 61 that forms a tongue plate guiding surface continuously with the tongue plate guiding portion 21 of the buckle body 2, and a pair of side walls 62 that rise from both left and right end portions of the bottom wall 61.

A holding hole 68 extending in the front-rear direction is formed in the bottom wall 61. The ejector 7 is inserted into the holding hole 68 to be slidable in the front-rear direction. The ejector 7 is biased forward by a spring 11.

Figure 8:
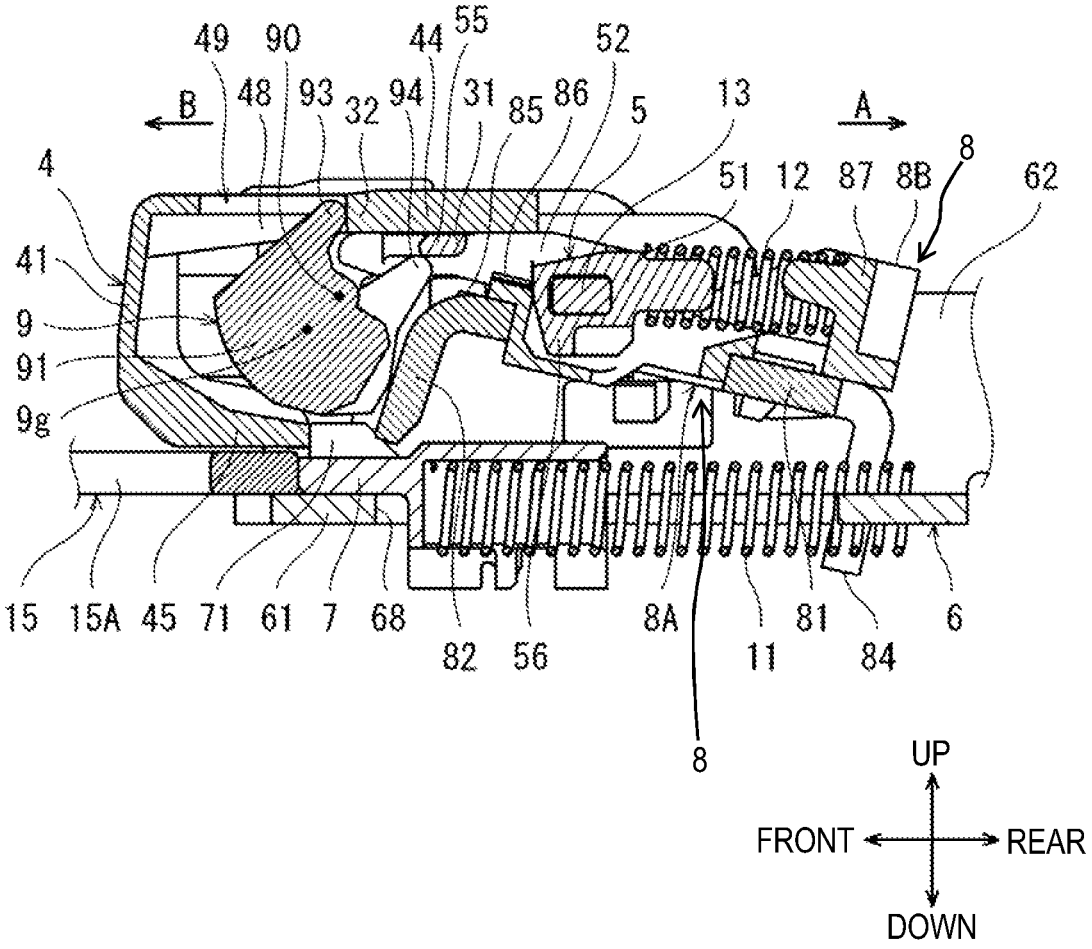
FIG. 8 shows a disengaged state in a cross section taken along a line VIII-VIII of FIG. 2.

The ejector 7 is provided with a pair of left and right bosses 71 protruding upward. As shown in FIG. 8, in a disengaged state of the tongue plate 15 (for example, in a state where the tongue plate 15 is not inserted into the buckle body 2), the bosses 71 press a bulge portion 45, to be described later, of the release button 4 by a biasing force of the spring 11.

A first recess portion 66 opened forward is formed in a front end portion of each side wall 62, and a second recess portion 63 opened upward is formed in a central portion of each side wall 62. A third recess portion 67 recessed downward from a center of the first recess portion 66 is formed in each side wall 62. Further, a first slit 65 and a second slit 64 extending in the front-rear direction are formed at positions rearward of the first recess portion 66 and forward of the second recess portion 63, in each side wall 62. The second slit 64 is located below the first slit 65. When viewed in an up-down direction, a rear portion of the first slit 65 and a front portion of the second slit 64 overlap each other.

In the present embodiment, the engagement member 8 includes a metal portion 8A and a resin portion 8B that are fitted to each other. A configuration of the engagement member 8 is not limited thereto, and can be changed as appropriate. The metal portion 8A is formed by bending a metal plate having a predetermined shape. Specifically, the metal portion 8A includes a base portion 81 extending in the front-rear direction, a hook portion 82 hanging down from a front end portion of the base portion 81, and a pair of left and right leg portions 84 hanging down from a rear end portion of the base portion 81. The base portion 81 has a through hole to which the resin portion 8B fits. The resin portion 8B includes a first limiting portion 86 located on the front end portion of the base portion 81, and a spring receiving portion 87 located on the rear end portion of the base portion 81.

Further, the metal portion 8A includes a pair of fulcrum portions 83 projecting, in the left-right direction, from the rear end portion of the base portion 81, and a pair of second limiting portions 85 projecting in the left-right direction from the front end portion of the base portion 81 and then projecting forward. In a case where the fulcrum portions 83 are inserted into the second recess portion 63 formed in the side walls 62 of the frame 6, the engagement member 8 is supported by the frame 6 to be swingable about the fulcrum portions 83 as fulcrums.

Figure 9A:
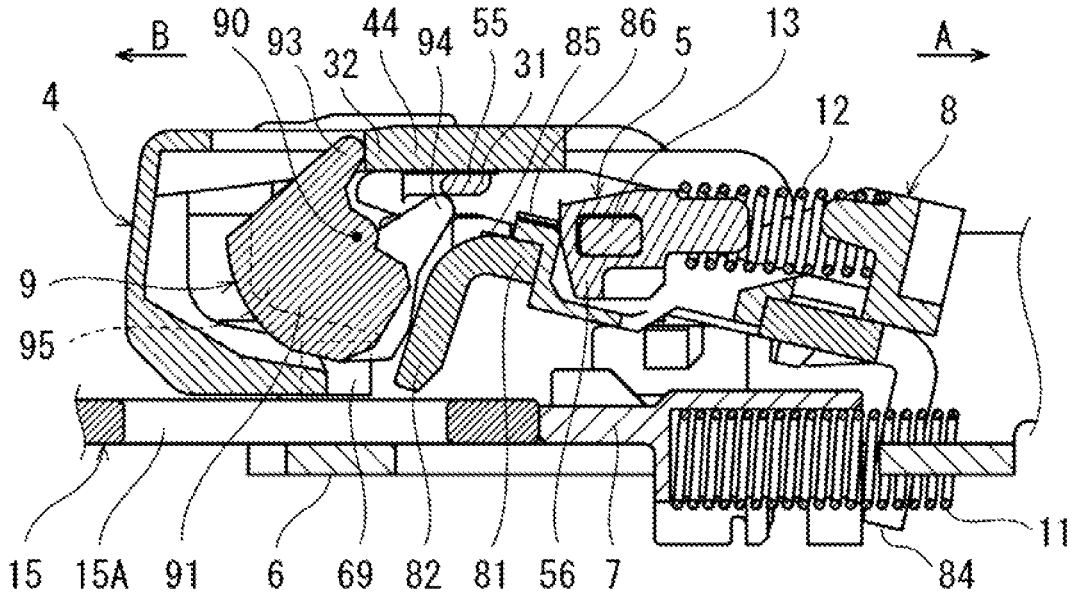
FIG. 9A shows an action of the mechanical assembly in a case where the tongue plate is engaged with the buckle device.
Figure 9B:
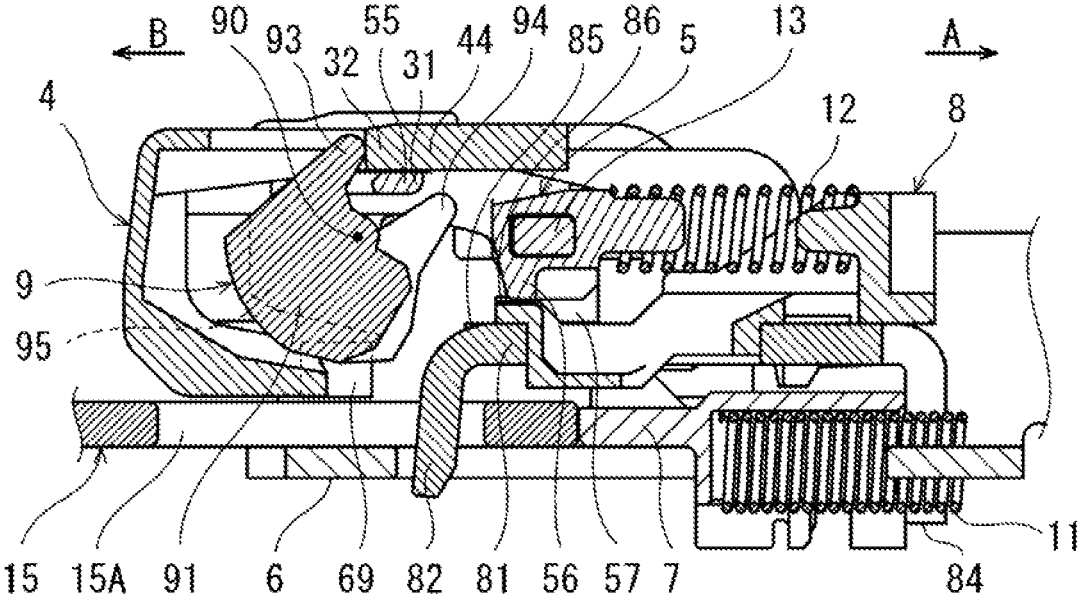
FIG. 9B shows an action of the mechanical assembly in a case where the tongue plate is engaged with the buckle device.
Figure 9C:
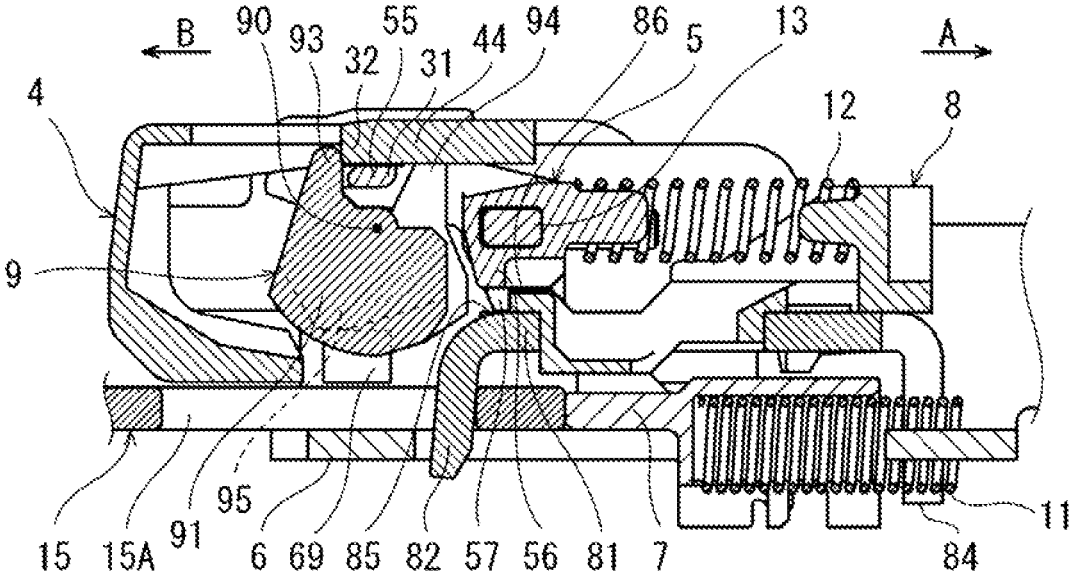
FIG. 9C shows an action of the mechanical assembly in a case where the tongue plate is engaged with the buckle device.

The lock member 5 moves between a standby position shown in FIG. 8 and a lock position shown in FIG. 9C. In a case where the engagement member 8 is engaged with the tongue plate 15, the lock member 5 is operated in a lock direction, which is forward in the present embodiment, from the standby position to prevent the engagement of the engagement member 8 from being released. In a case where the release button 4 is operated rearward toward an inner side of the buckle body 2, the lock member 5 is operated in a direction opposite to the lock direction, which is rearward in the present embodiment, from the lock position to enable the engagement of the engagement member 8 to be released.

Figure 7:
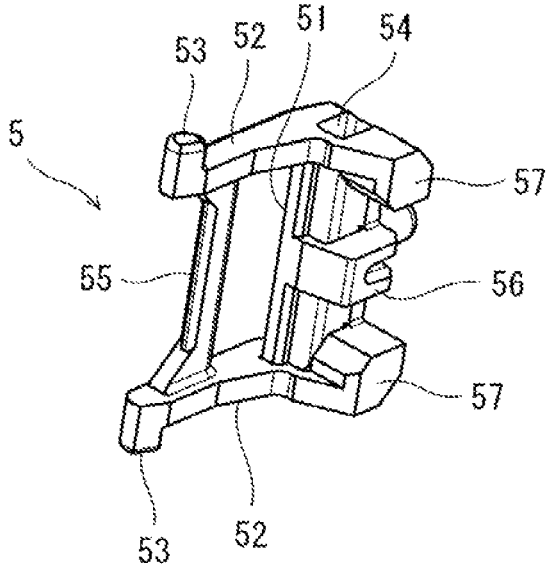
FIG. 7 is a perspective view of a lock member as viewed obliquely from below.

More specifically, as shown in FIGS. 4 and 7, the lock member 5 includes a resin portion including a base portion 51 extending in the left-right direction, and a metal lock bar 13 to be inserted into a through hole 54 penetrating the base portion 51 in the left-right direction. The base portion 51 is provided with a pair of arm portions 52 extending forward from both end portions of the base portion 51. Front portions of the arm portions 52 are connected to each other by a bridge portion 55 extending in the left-right direction. Both end portions of the lock bar 13 protrude from the base portion 51.

Further, a pair of bosses 53 protruding outward are provided at respective distal ends of the pair of arm portions 52. Both end portions of the lock bar 13 are inserted into the first slits 65 formed in the side walls 62 of the frame 6, and the bosses 53 are inserted into the first recess portion 66 formed in the side walls 62, and thus, the lock member 5 is supported by the frame 6 to be slidable in the front-rear direction.

A spring 12 is disposed between the base portion 51 of the lock member 5 and the spring receiving portion 87 of the engagement member 8. The spring 12 is omitted in FIGS. 2 and 3 for simplification of the drawings. The spring 12 biases the engagement member 8 to swing upward, that is, the hook portion 82 moves upward, and biases the lock member 5 forward.

The lock member 5 includes a first limiting portion 56 protruding downward from the center of the base portion 51, and a pair of second limiting portions 57 protruding downward from respective end portions of the base portion 51. As shown in FIG. 8, in the disengaged state of the tongue plate 15, the front end portion of the base portion 51 is configured to come in contact with the first limiting portion 86 of the engagement member 8 from behind. Accordingly, the lock member 5 is maintained at the standby position.

In a state from a state shown in FIG. 9A to a state shown in FIG. 9B during the engagement of the tongue plate 15, until the engagement member 8 swings downward and the first limiting portion 86 of the engagement member 8 is located below the first limiting portion 56 of the lock member 5, the first limiting portion 56 moves forward while contacting the first limiting portion 86 of the engagement member 8 swinging downward. In a case where the first limiting portion 86 of the engagement member 8 is located below the first limiting portion 56 of the lock member 5 as shown in FIG. 9B, the second limiting portion 57 of the lock member 5 moves forward while sliding on the second limiting portion 85 of the engagement member 8. In the engaged state of the tongue plate 15 shown in FIG. 9C, the second limiting portion 57 comes in contact with the second limiting portion 85 of the engagement member 8. Accordingly, the state in which the engagement member 8 swings downward is maintained.

Figure 5A:
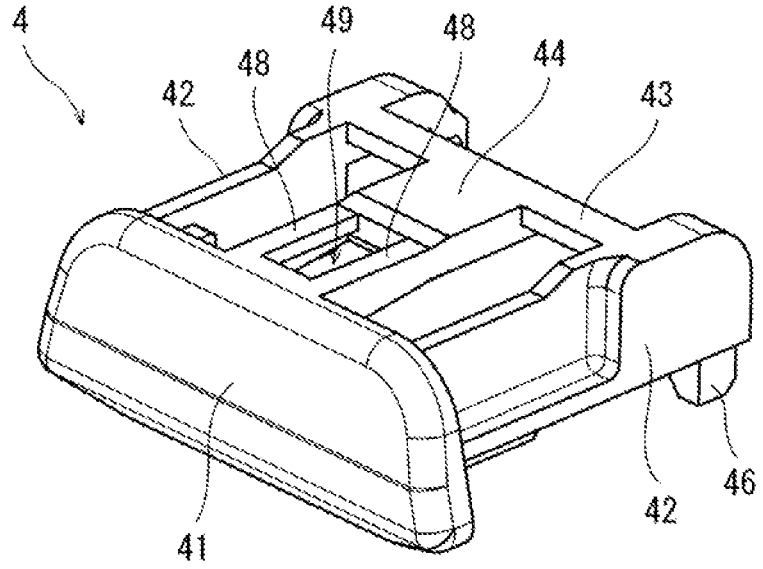
FIG. 5A is a perspective view of the release button as viewed obliquely from above.
Figure 5B:
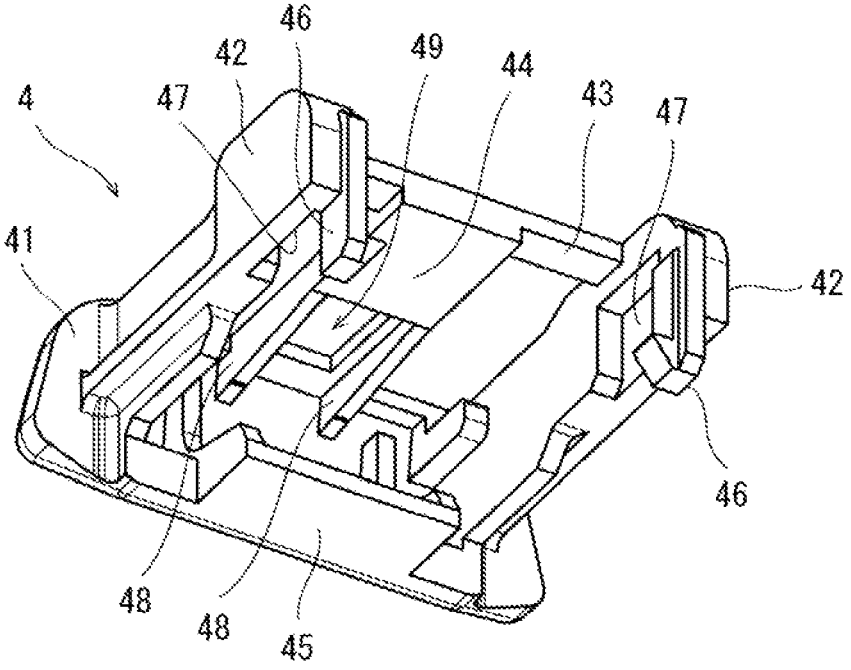
FIG. 5B is a perspective view of the release button as viewed obliquely from below.

As shown in FIGS. 5A and 5B, the release button 4 includes a front wall 41 that is long in the left-right direction, and a pair of side walls 42 that extend rearward from the front wall 41 and that sandwich both side walls 62 of the frame 6. Upper ends of rear portions of the side walls 42 are connected to each other by a bridge portion 43 extending in the left-right direction.

A bulge portion 44 bulging forward is provided at the center of the bridge portion 43. The bulge portion 44 is connected to the center of an upper end portion of the front wall 41 via a pair of left and right ribs 48. An opening 49, into which a second lever 93 of the inertia member 9 to be described later is inserted, is formed between the ribs 48. A bulge portion 45 bulging rearward is provided at the center of a lower end portion of the front wall 41.

Rear end portions of both side walls 42 are provided with respective attachment portions 46 each having a claw hanging downward and protruding inward at tips of the claw. The bridge portion 43 is placed on respective upper end surfaces of both side walls 62 of the frame 6, and the claws of the attachment portions 46 are inserted into the respective second slits 64 formed in the side walls 62, and thus, the release button 4 is supported by the frame 6 to be slidable in the front-rear direction.

As shown in FIG. 3, a length of the lock bar 13 is set to be longer than a width of the frame 6, and both end portions of the lock bar 13 protrude outward of the side walls 62 of the frame 6. As shown in FIGS. 5A and 5B, a groove 47, into which the end portion of the lock bar 13 is inserted and whose width in the front-rear direction is longer than a width of the lock bar 13, is formed on an inner surface of each side wall 42 of the release button 4. In the disengaged state of the tongue plate 15, the end portion of the lock bar 13 is located near a rear side surface of the groove 47 with a space, and, in the engaged state of the tongue plate 15, the end portion of the lock bar 13 comes into contact with a front side surface of the groove 47.

Figure 6A:
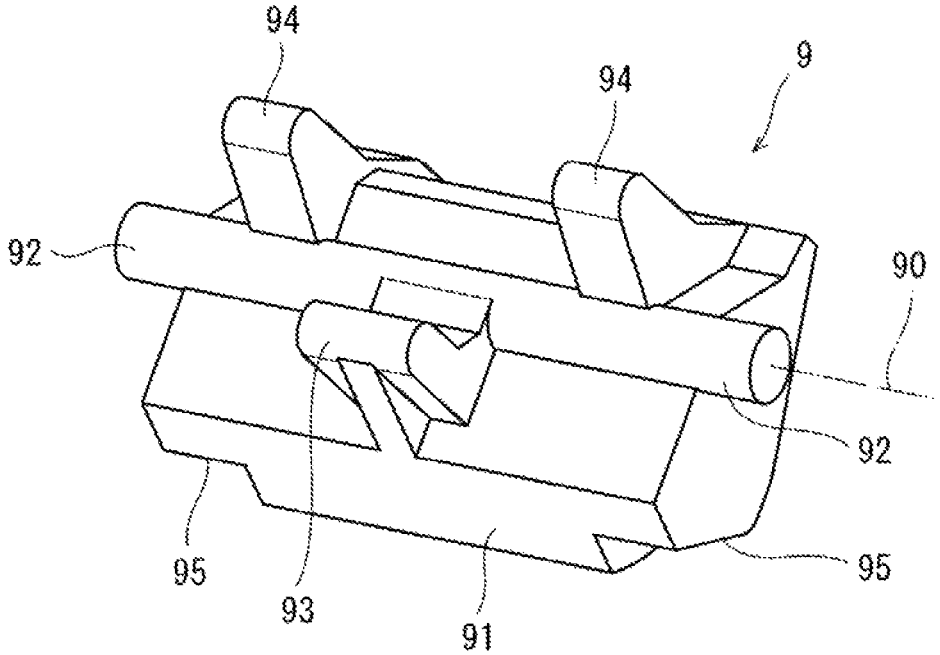
FIG. 6A is a perspective view of an inertia member as viewed obliquely from above.
Figure 6B:
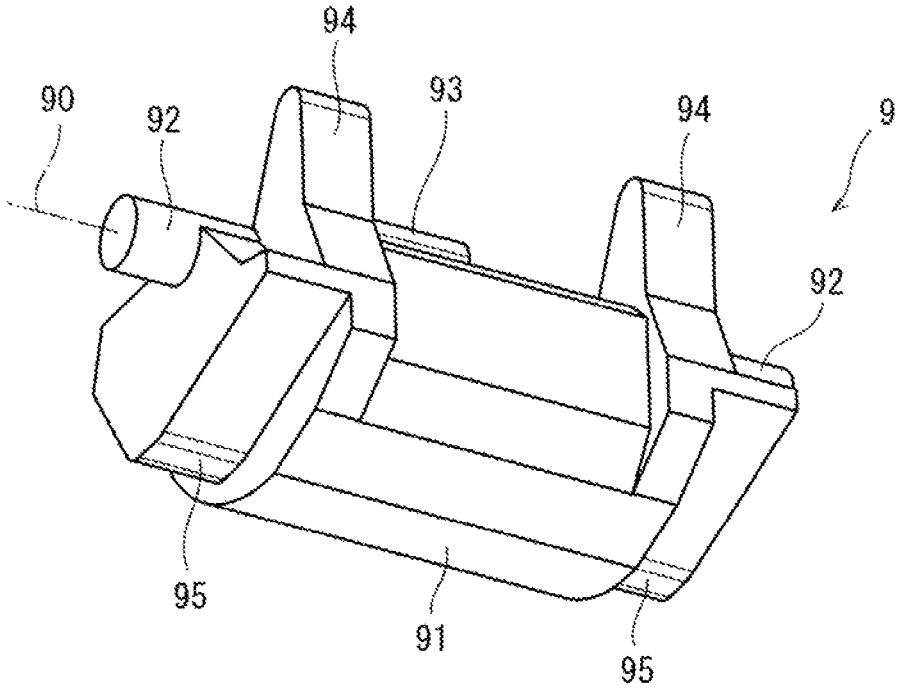
FIG. 6B is a perspective view of the inertia member as viewed obliquely from below.

As shown in FIG. 8, the inertia member 9 is supported by the frame 6 to be rotatable about a rotation center axis 90 extending in the left-right direction. Specifically, as shown in FIGS. 6A and 6B, the inertia member 9 includes a main body portion 91 through which the rotation center axis 90 penetrates, and two first levers 94 and a second lever 93 protruding from the main body portion 91 in a direction away from the rotation center axis 90. The first levers 94 and the second lever 93 are arranged at a predetermined interval in the front-rear direction when viewed in the left-right direction, which is an extending direction of the rotation center axis 90.

The main body portion 91 is configured to provide a center of gravity 9*g* (see FIG. 8) of the inertia member 9 at a position away from the rotation center axis 90. In the present embodiment, the center of gravity 9*g* of the inertia member 9 is located below the rotation center axis 90.

A pair of shaft portions 92 protrude, along the rotation center axis 90, from respective side surfaces of the main body portion 91. The shaft portions 92 are inserted into the respective third recess portion 67 formed in the side walls 62 of the frame 6, and thus, the inertia member 9 is supported by the frame 6 to be rotatable about the rotation center axis 90.

In the left-right direction, the second lever 93 is disposed at the center of the main body portion 91, and the two first levers 94 are disposed on respective sides of the second lever 93. The first levers 94 protrude from the main body portion 91 at a position rearward of the rotation center axis 90, and the second lever 93 protrudes from the main body portion 91 at a position forward of the rotation center axis 90. That is, the first levers 94 are located at the inner side of the buckle body 2 than the second lever 93, in the insertion direction of the tongue plate 15. A protruding direction of the first levers 94 and the second lever 93 is substantially parallel to a line connecting the center of gravity 9*g* and the rotation center axis 90.

Stoppers 95 pointed obliquely downward are provided at respective end portions of the main body portion 91. Further, a protruding portion 69 configured to come in contact with the stopper 95 is provided on an inner surface of a front portion of each side wall 62 of the frame 6.

Figure 10A:
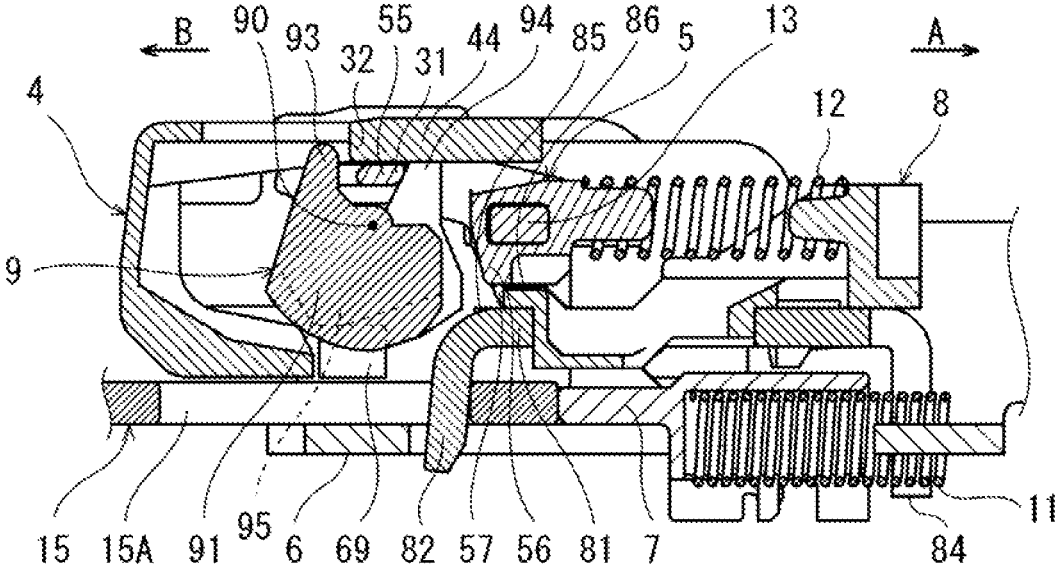
FIG. 10A shows an action of the mechanical assembly in a case where engagement of the tongue plate is released.
Figure 10B:
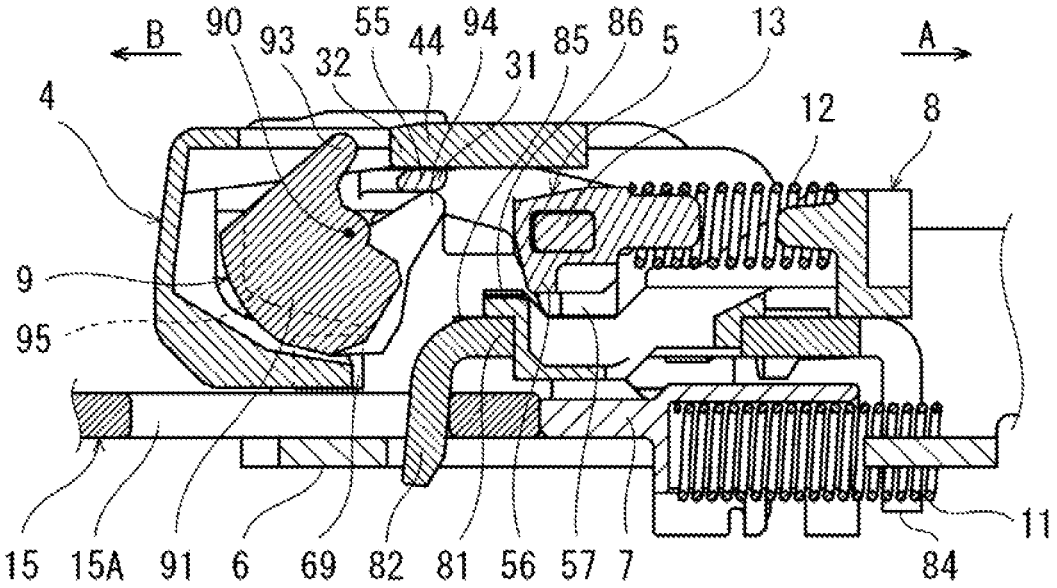
FIG. 10B shows an action of the mechanical assembly in a case where engagement of the tongue plate is released.
Figure 10C:
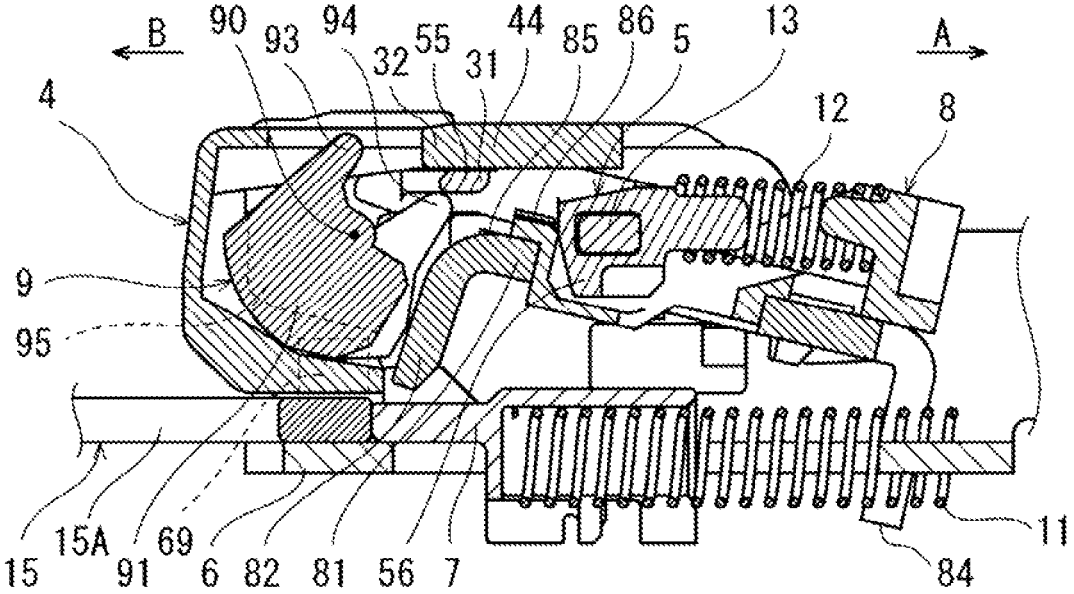
FIG. 10C shows an action of the mechanical assembly in a case where engagement of the tongue plate is released.

Next, actions of the buckle device 1 will be described with reference to FIGS. 9A to 10C. FIGS. 9A to 9C show actions of the mechanical assembly 10 in a case where the tongue plate 15 is engaged with the buckle device 1, and FIGS. 10A to 10C show actions of the mechanical assembly 10 in a case where the engagement of the tongue plate 15 is released. Hereinafter, the insertion direction of the tongue plate 15 is referred to as an A direction, and a direction opposite to the insertion direction of the tongue plate 15 is referred to as a B direction.

First, the disengaged state of the tongue plate 15 will be described with reference to FIG. 8. The engagement member 8 is maintained in a state of being swung upward by the biasing force of the spring 12. The lock member 5 is biased in the B direction by the spring 12, and the front end portion of the base portion 51 of the lock member 5 comes in contact with the first limiting portion 86 of the engagement member 8. The release button 4 is biased in the B direction by the spring 11 via the ejector 7, and a front end portion of the bulge portion 44 of the release button 4 is brought into contact with the second lever 93 of the inertia member 9 located in the opening 49 of the release button 4.

In the disengaged state of the tongue plate 15, the inertia member 9 is biased, by the spring 11 via the release button 4, to rotate in a direction from the first lever 94 toward the second lever 93, that is, counterclockwise in FIG. 7, and the first levers 94 come in contact with a lower surface of the bridge portion 55 of the lock member 5. Accordingly, the movement of the release button 4 and the rotation of the inertia member 9 are prevented, and thus, it is possible to prevent abnormal noise due to rattling of the release button 4 and the inertia member 9.

As shown in FIG. 9A, in a case where the tongue plate 15 is inserted into the buckle body 2, the ejector 7 is pressed by the tongue plate 15 and moves in the A direction until the ejector 7 comes in contact with the leg portion 84 of the engagement member 8. Thereafter, the ejector 7 is pressed by the tongue plate 15 and moves in the A direction, and thus, the engagement member 8 swings downward and the hook portion 82 of the engagement member 8 is inserted into an engagement hole 15A provided in the tongue plate 15, as shown in FIG. 9B.

In a case where the engagement member 8 swings downward until the first limiting portion 86 of the engagement member 8 is located below the first limiting portion 56 of the lock member 5, the lock member 5 moves in the B direction by the biasing force of the spring 12. During the movement of the lock member 5, the first limiting portion 56 of the lock member 5 slides on the first limiting portion 86 of the engagement member 8.

The lock member 5 alone moves in the B direction until both end portions of the lock bar 13 come in contact with the front side surfaces of the grooves 47 of the release button 4, which is the state shown in FIG. 9B, and thereafter, as shown in FIG. 9C, the lock member 5 moves in the B direction together with the release button 4.

Regarding the action of the inertia member 9, in a case where the lock member 5 moves in the B direction until both end portions of the lock bar 13 come in contact with the front side surfaces of the grooves 47 of the release button 4, the bridge portion 55 of the lock member 5 enters between the first lever 94 and the second lever 93 of the inertia member 9 when viewed in the left-right direction, which is the extending direction of the rotation center axis 90, as shown in FIG. 9B. After that, by movement of the lock member 5 and the release button 4 in the B direction, the second lever 93 of the inertia member 9 is pressed by the front end portion of the bulge portion 44 of the release button 4, and thus, the inertia member 9 rotates in a direction from the first lever 94 toward the second lever 93, which is counterclockwise in FIG. 9C. The rotation of the inertia member 9 is stopped in a case where the stopper 95 of the inertia member 9 comes in contact with the protruding portion 69 of the frame 6, and thus, the movement of the lock member 5 and the release button 4 in the B direction is also stopped. The position is the lock position of the lock member 5. That is, in the lock position, the release button 4 is biased in the B direction by the spring 12 via the lock member 5. In a case where the lock member 5 moves to the lock position, the second limiting portion 57 of the lock member 5 comes in contact with the second limiting portion 85 of the engagement member 8.

Thereafter, in a case where the pressing of the tongue plate 15 by an operator is released, the tongue plate 15 is biased by the spring 11 via the ejector 7, and thus the tongue plate 15 is pressed against the hook portion 82 of the engagement member 8. Accordingly, the engaged state of the tongue plate 15 shown in FIG. 9C is formed. In the engaged state of the tongue plate 15, the first levers 94 and the second lever 93 are located on a side opposite to the tongue plate 15 with respect to the rotation center axis 90.

In a case where the engagement of the tongue plate 15 is released, the release button 4 receives the release operation and moves, together with the lock member 5, in the A direction against the biasing force of the spring 12, and the front end portion of the bulge portion 44 of the release button 4 is separated from the second lever 93 of the inertia member 9, as shown in FIG. 10A. As shown in FIG. 10B, as the release button 4 moves to the inner side of the buckle body 2 in the A direction of the lock member 5, the bridge portion 55 of the lock member 5 presses the first levers 94 of the inertia member 9. Accordingly, the inertia member 9 rotates in a direction, which is clockwise in FIG. 10B, from the second lever 93 toward the first lever 94. Accordingly, the bridge portion 55 of the lock member 5 moves in a direction away from a space between the first lever 94 and the second lever 93 of the inertia member 9.

In a case where the lock member 5 moves in the A direction until the first limiting portion 56 of the lock member 5 is located behind the first limiting portion 86 of the engagement member 8, the engagement member 8 swings upward by the biasing force of the spring 12, and the engagement between the hook portion 82 of the engagement member 8 and the tongue plate 15 is released, as shown in FIG. 10C. Accordingly, the tongue plate 15 is pushed out, by the biasing force of the spring 11, until the boss 71 of the ejector 7 comes in contact with the bulge portion 45 of the release button 4. In this state, the front end portion of the bulge portion 44 of the release button 4 and the bridge portion 55 of the lock member 5 are away from the space between the first lever 94 and the second lever 93 of the inertia member 9.

Thereafter, in a case where the pressing of the release button 4 by the operator is released, the release button 4 is moved to a position shown in FIG. 8 by the biasing force of the spring 11.

Figure 11A:
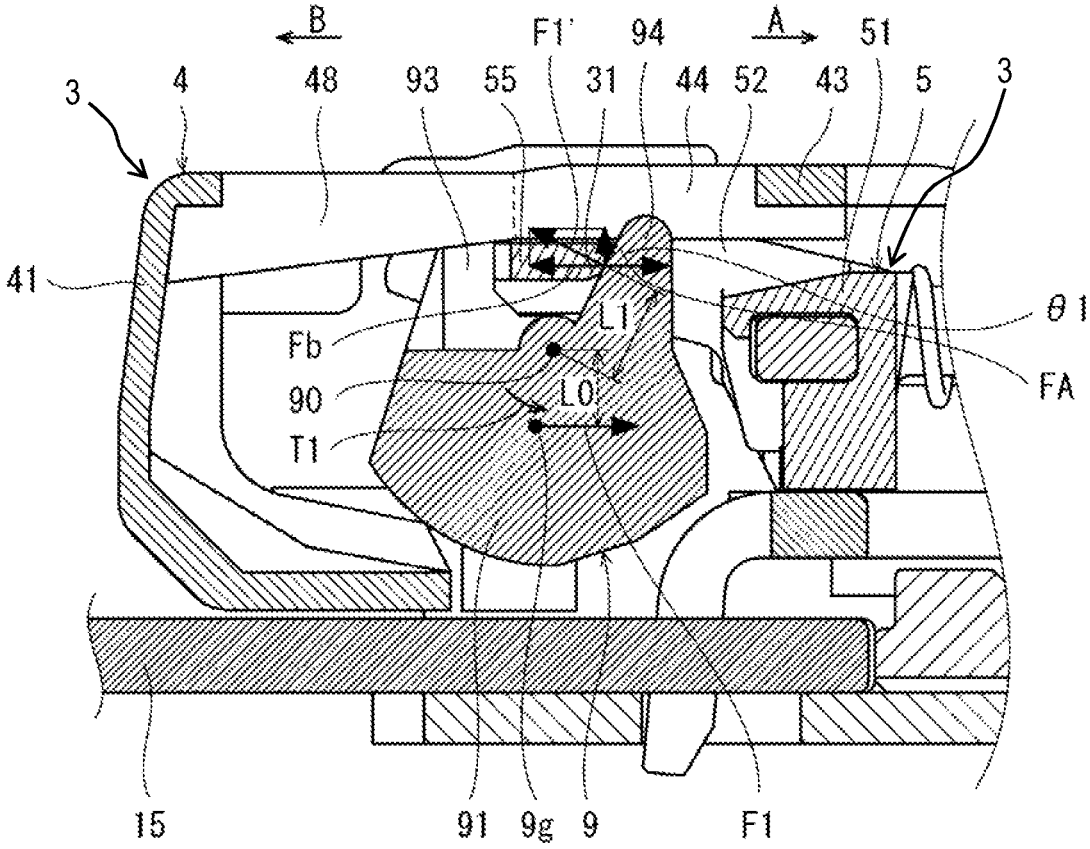
FIG. 11A is a cross-sectional view of the mechanical assembly at a position traversing a first lever and a second lever in an engaged state of the tongue plate, in a case where a first inertial force in an insertion direction of the tongue plate acts on an operating member.
Figure 11B:
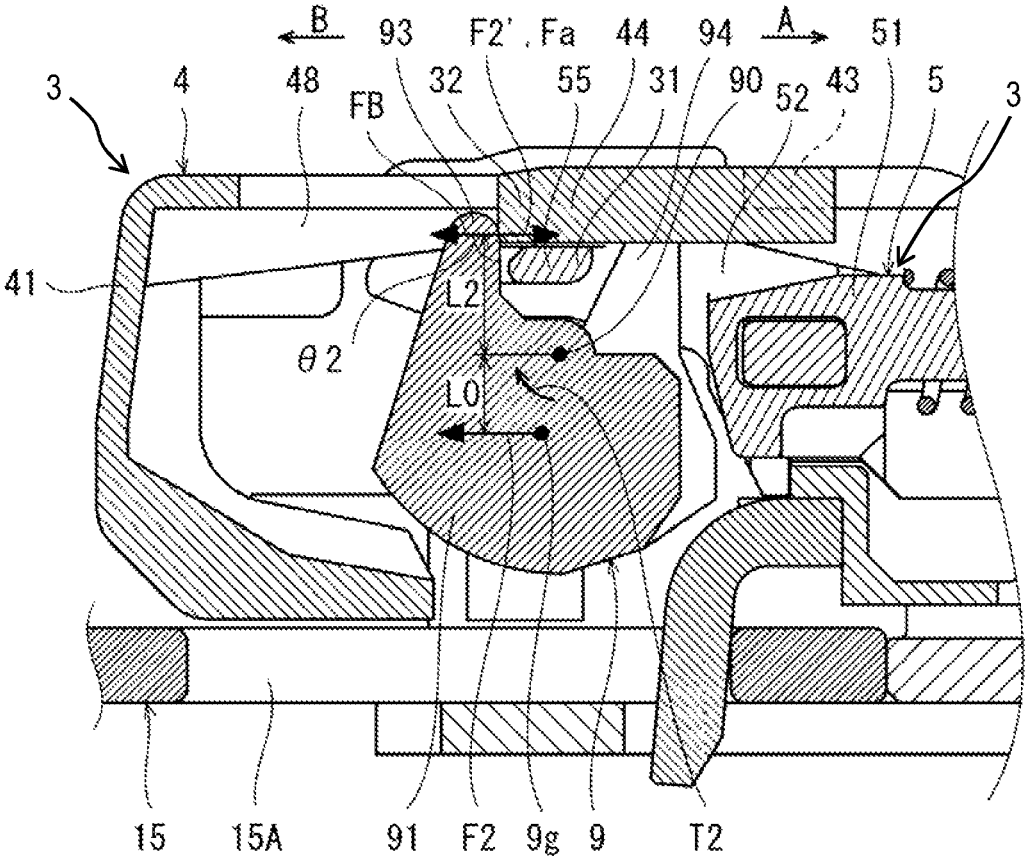
FIG. 11B is a cross-sectional view of the mechanical assembly at a position traversing a first lever and a second lever in an engaged state of the tongue plate, in a case where a second inertial force in a direction opposite to the insertion direction of the tongue plate acts on the operating member.

Next, operations of the first lever 94 and the second lever 93 of the inertia member 9 will be described in detail with reference to FIGS. 11A and 11B. As shown in FIGS. 11A and 11B, in the engaged state of the tongue plate 15, a rear end portion of the bridge portion 55 of the lock member 5 is configured to come in contact with the first lever 94, and the front end portion of the bulge portion 44 of the release button 4 is configured to come in contact with the second lever 93. That is, the rear end portion of the bridge portion 55 of the lock member 5 configures a first contact portion 31 of the operating member 3, and the front end portion of the bulge portion 44 of the release button 4 configures a second contact portion 32 of the operating member 3.

In the engaged state of the tongue plate 15, the first contact portion 31 and the second contact portion 32 are located between the first lever 94 and the second lever 93 in the front-rear direction when viewed in the left-right direction, which is the extending direction of the rotation center axis 90. As shown in FIGS. 10A to 10C, in a case where the engagement of the tongue plate 15 is released, the first contact portion 31 and the second contact portion 32 move in a direction away from the space between the first lever 94 and the second lever 93 in accordance with the rotation of the inertia member 9, and in a state shown in FIG. 10C, the first contact portion 31 and the second contact portion 32 are away from the space between the first lever 94 and the second lever 93.

As shown in FIG. 11A, in a case where a first inertial force FA in the A direction acts on the operating member 3 in the engaged state of the tongue plate 15, an inertial force F1 in the A direction acts on the inertia member 9. The first lever 94 applies a first pressing force Fb, in the B direction to the first contact portion 31, by the inertial force F1 in the A direction. The first pressing force Fb is set to be larger than the first inertial force FA.

Regarding the inertial force F1 in the A direction acting on the inertia member 9, in a case where a distance, in a direction orthogonal to a direction of the inertial force F1, from the rotation center axis 90 to the center of gravity 9*g* of the inertia member 9 is defined as a distance L0, a torque T1 of F1×L0 is generated in the inertia member 9 around the rotation center axis 90, which is counterclockwise in FIG. 11A. At a contact point between the first contact portion 31 and the first lever 94, a direction of a force F1' applied from the first lever 94 to the first contact portion 31 by the torque T1 is orthogonal to a surface, located on a side of the first contact portion 31, of the first lever 94. Further, the following relation is satisfied: F1'=T1/L1, where L1 is a first distance, in a direction parallel to the surface, located on a side of the first contact portion 31, of the first lever 94, from the contact point between the first contact portion 31 and the first lever 94 to the rotation center axis 90. Therefore, the first pressing force Fb is a component force of the force F1' in the direction of the first inertial force FA, that is the A direction, and thus, the following relation is satisfied: Fb=F1'×sin θ1, that is, Fb=(T1/L1)×sin θ1, where θ1 is a first angle formed by an acting direction of the first inertial force FA and the surface, located on a side of the first contact portion 31, of the first lever 94.

As shown in FIG. 11B, in a case where a second inertial force FB in the B direction acts on the operating member 3 in the engaged state of the tongue plate 15, an inertial force F2 in the B direction acts on the inertia member 9. The second lever 93 applies a second pressing force Fa in the A direction to the second contact portion 32 by the inertial force F2 in the B direction. The second pressing force Fa is set to be smaller than the second inertial force FB.

Regarding the inertial force F2 in the B direction acting on the inertia member 9, in a case where a distance, in a direction orthogonal to a direction of the inertial force F2, from the rotation center axis 90 to the center of gravity 9*g* of the inertia member 9 is defined as a distance L0, a torque T2 of F2×L0 is generated in the inertia member 9 around the rotation center axis 90, which is clockwise in FIG. 11B. At a contact point between the second contact portion 32 and the second lever 93, a direction of a force F2' applied from the second lever 93 to the second contact portion 32 by the torque T2 is orthogonal to a surface, located on a side of the second contact portion 32, of the second lever 93. Further, the following relation is satisfied: F2'=T2/L2, where L2 is a second distance, in a direction parallel to the surface, located on a side of the second contact portion 32, of the second lever 93, from the contact point between the second contact portion 32 and the second lever 93 to the rotation center axis 90. Therefore, the second pressing force Fa is a component force of the force F2' in the direction of the second inertial force FB, that is the B direction, and thus, the following relation is satisfied: Fa=F2'×sin θ2, that is, Fa=(T2/L2)×sin θ2, where θ2 is a second angle formed by an acting direction of the second inertial force FB and the surface, located on a side of the second contact portion 32, of the second lever 93. In the present embodiment, since the second angle θ2 is 90°, the second pressing force Fa is the same as the force F2'.

In a case where the inertial force in the A direction and the inertial force in the B direction are the same, the first inertial force FA and the second inertial force FB acting on the operating member 3 are the same. Therefore, in order to make strength of the first pressing force Fb larger than that of the first inertial force FA, and in order to make strength of the second pressing force Fa smaller than that of the second inertial force FB, in the present embodiment, strength of the first pressing force Fb is set larger than that of the second pressing force Fa, and strength of the first inertial force FA and the second inertial force FB are set to have strength between strength of the first pressing force Fb and strength of the second pressing force Fa.

In a case where the inertial force in the A direction and the inertial force in the B direction are the same, the inertial force F1 and the inertial force F2 acting on the inertia member 9 are also the same. As a result, the torque T1 and the torque T2 of the inertia member are also the same. Therefore, since Fb=(T1/L1)×sin θ1 and Fa=(T2/L2)×sin θ2, it is possible to set the first pressing force Fb to be larger than the second pressing force Fa by, for example, at least one of making the first distance L1 smaller than the second distance L2 or making the first angle θ1 larger than the second angle θ2 in a range of 90° or less. In the present embodiment, although the first angle θ1 is smaller than the second angle θ2 due to shape restrictions, the first pressing force Fb is set to be larger than the second pressing force Fa by appropriately setting the first distance L1 to be smaller than the second distance L2. In this way, the first lever 94 and the second lever 93 can individually adjust the first distance L1, the second distance L2, the first angle θ1, and the second angle θ2 as long as the first pressing force Fb is larger than the second pressing force Fa. Thus, the first lever 94 and the second lever 93 have a degree of freedom in design, and are easily provided in consideration of the strength thereof, the shape of other members, and the like.

As described above, in the buckle device 1 of the present embodiment, in a case where the first inertial force FA in the A direction acts on the operating member 3, the first pressing force Fb, which is larger than the first inertial force FA, in a direction opposite to the first inertial force FA is applied from the first lever 94 of the inertia member 9 to the operating member 3. Thus, the operating member 3 is prevented from being operated. On the other hand, in a case where the second inertial force FB in the B direction acts on the operating member 3, the second pressing force Fa in a direction opposite to the second inertial force FB is applied from the second lever 93 of the inertia member 9 to the operating member 3. However, the second pressing force Fa is smaller than the second inertial force FB, and thus the operating member 3 is not operated in the A direction by the second lever 93. Therefore, the engagement of the tongue plate 15 can be reliably prevented from being released by an inertial force, regardless of a direction of the inertial force. In addition, since the first contact portion 31 and the first lever 94 for the first inertial force FA are provided separately from the second contact portion 32 and the second lever 93 for the second inertial force FB, the degree of freedom in design is high.

In the present embodiment, in the engaged state of the tongue plate 15, the release button 4 and the lock member 5, which are the operating member 3, are biased forward, which is in the B direction, by the spring 12, and thus the biasing force of the spring 12 acts to decrease the first inertial force FA and to increase the second inertial force FB. Accordingly, an effect of reliably preventing the engagement of the tongue plate 15 from being released by an inertial force, regardless of a direction of the inertial force can be enhanced.

(Modification)

The present disclosure is not limited to the above embodiment, and various modifications can be made without departing from the gist of the disclosure.

Figure 12A:
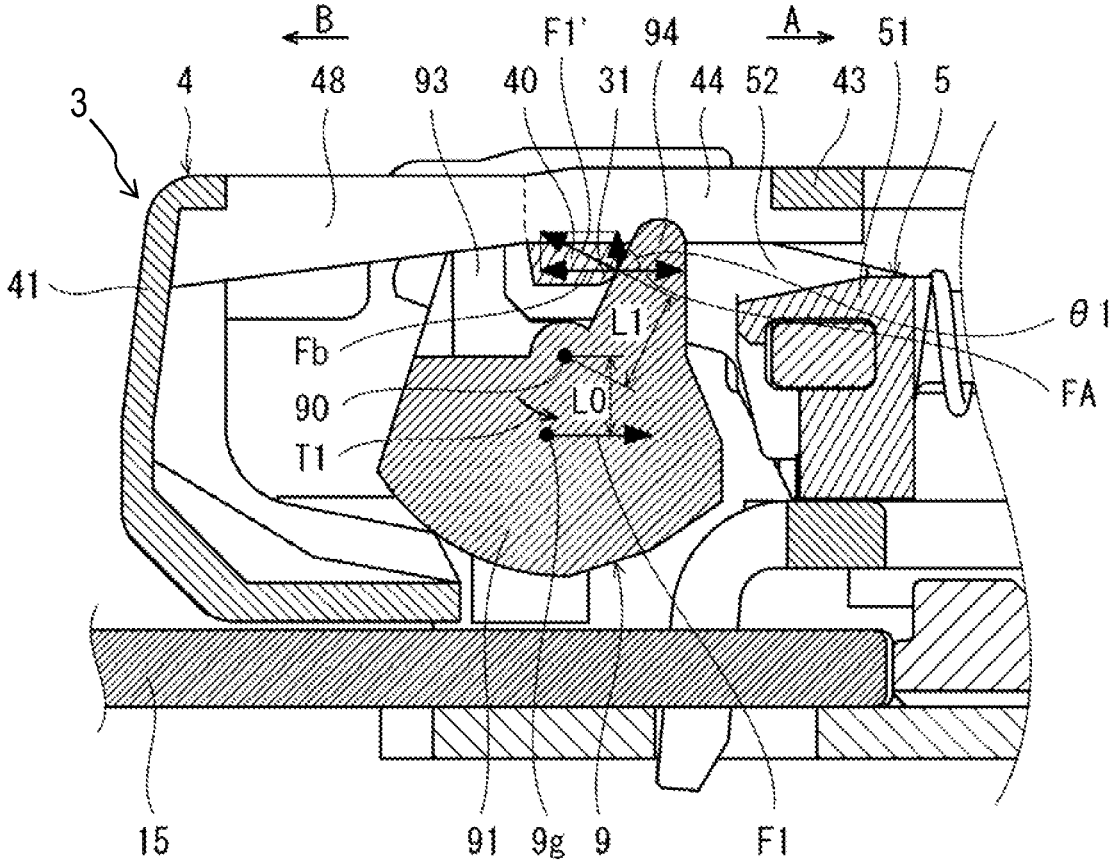
FIG. 12A is a cross-sectional view of a mechanical assembly of a buckle device according to a first modification at a position traversing a first lever and a second lever in an engaged state of the tongue plate, in a case where a first inertial force in an insertion direction of the tongue plate acts on an operating member.
Figure 12B:
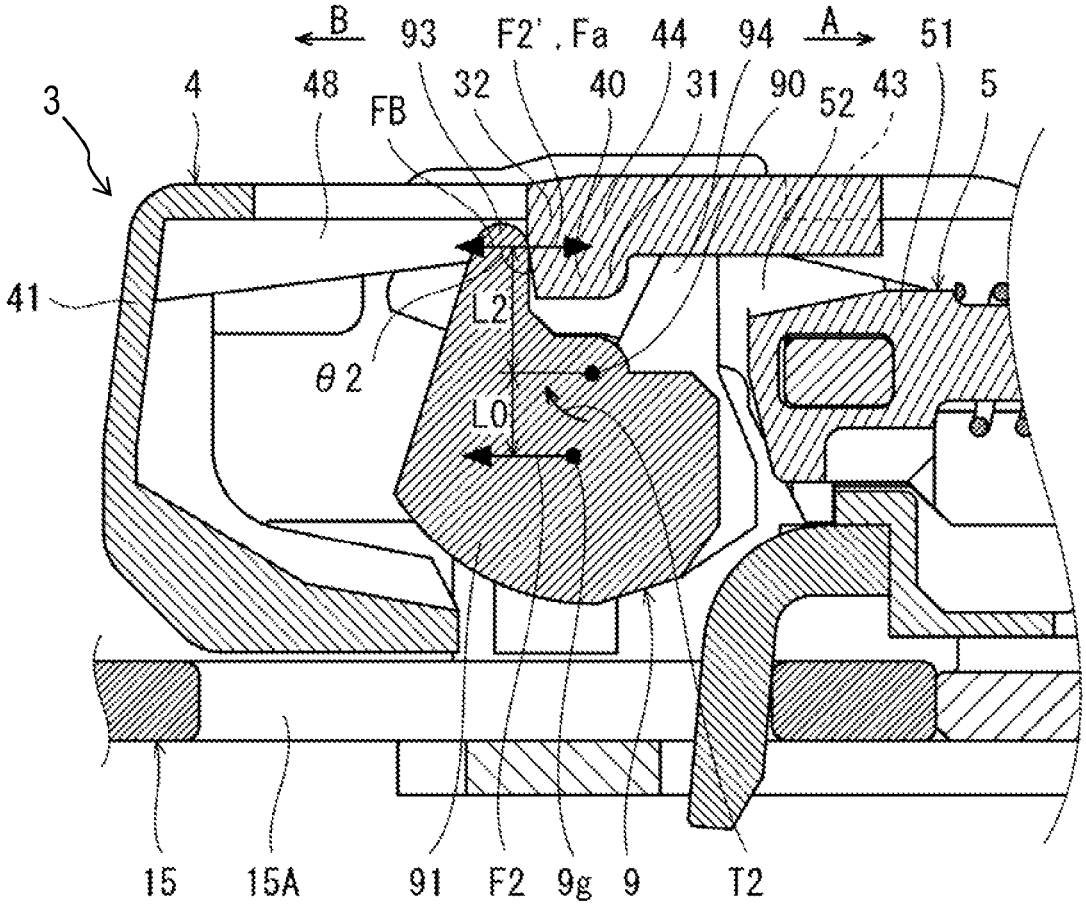
FIG. 12B is a cross-sectional view of a mechanical assembly of a buckle device according to a first modification at a position traversing a first lever and a second lever in an engaged state of the tongue plate, in a case where a second inertial force in a direction opposite to the insertion direction of the tongue plate acts on the operating member.
Figure 13A:
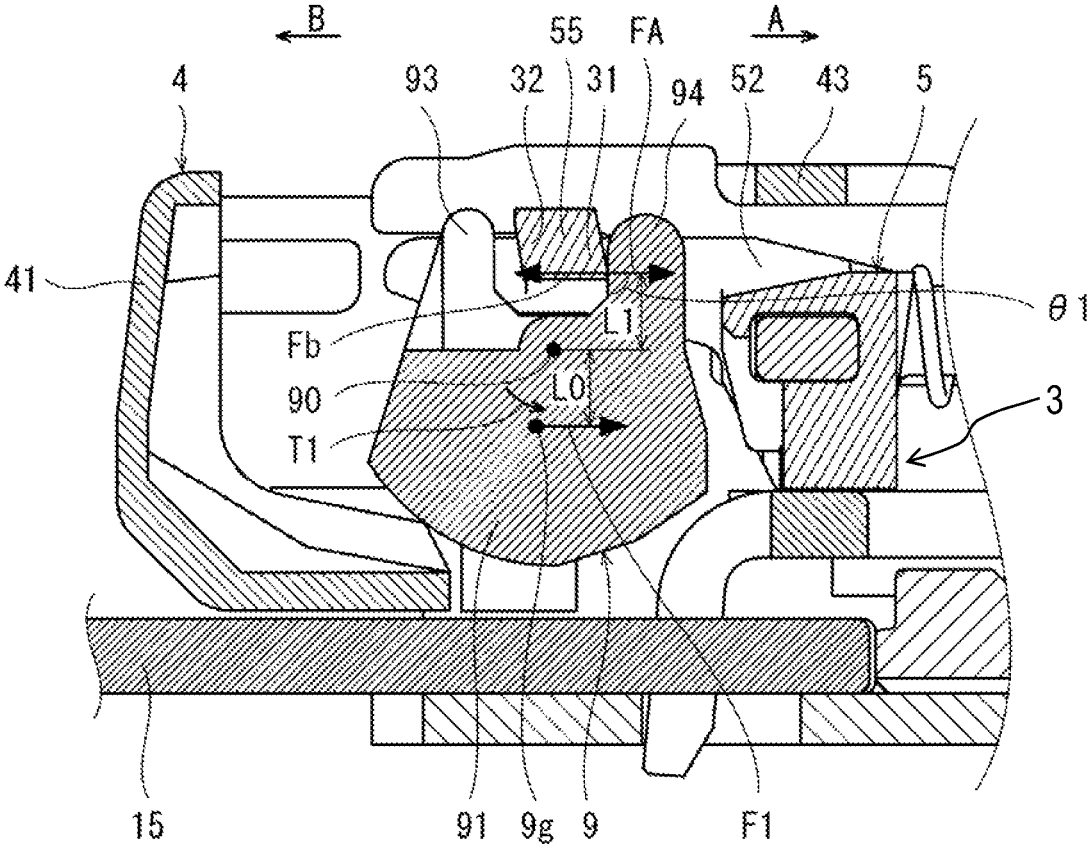
FIG. 13A is a cross-sectional view of a mechanical assembly of a buckle device according to a second modification at a position traversing a first lever and a second lever in an engaged state of the tongue plate, in a case where a first inertial force in an insertion direction of the tongue plate acts on an operating member.
Figure 13B:
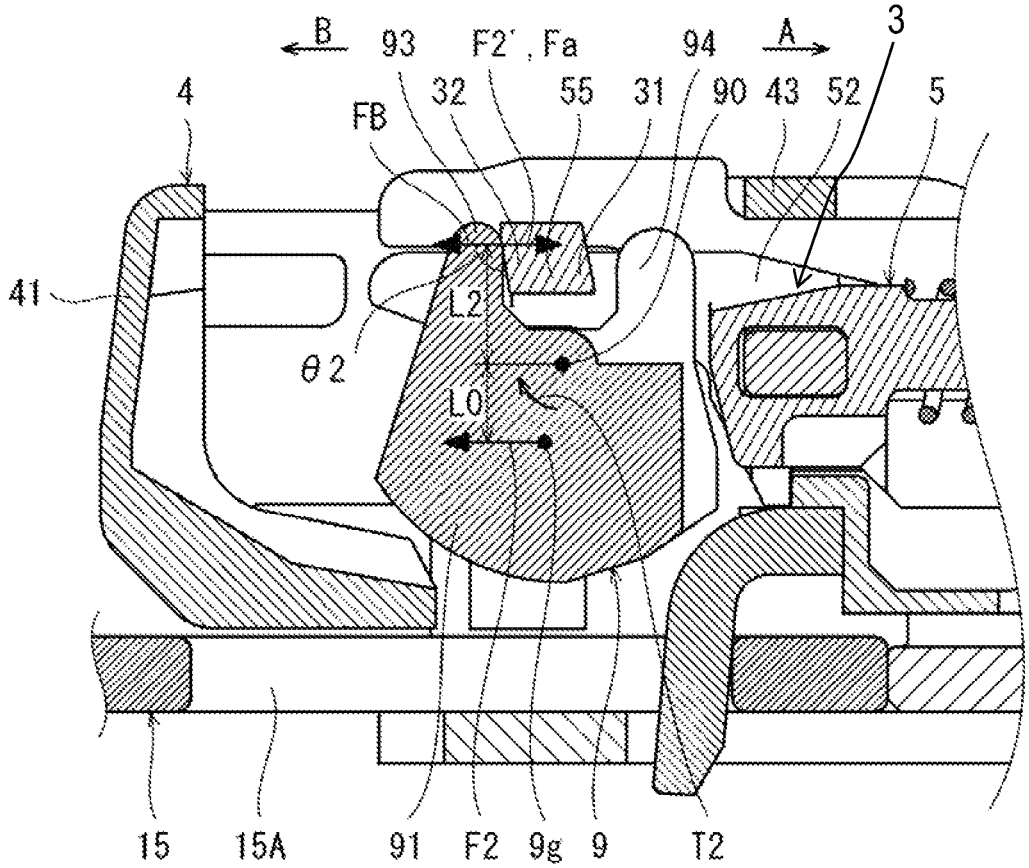
FIG. 13B is a cross-sectional view of a mechanical assembly of a buckle device according to a second modification at a position traversing a first lever and a second lever in an engaged state of the tongue plate, in a case where a second inertial force in a direction opposite to the insertion direction of the tongue plate acts on the operating member.

For example, the operating member 3 may be only the release button 4 as shown in FIGS. 12A and 12B, or the operating member 3 may be only the lock member 5 as shown in FIGS. 13A and 13B. In this way, in a case where the operating member 3 is at least one of the release button 4 or the lock member 5, since the buckle device 1 generally includes the release button 4 and the lock member 5, the first contact portion 31 and the second contact portion 32 can be provided without adding components. However, in a case where the operating member 3 is both the release button 4 and the lock member 5, the first contact portion 31 is provided on the lock member 5, and the second contact portion 32 is provided on the release button 4 as described in the above embodiment, it is possible to simplify the shape of the release button 4 and the shape of the lock member 5 to easily manufacture the release button 4 and the lock member 5, or to easily provide the release button 4 and the lock member 5 in consideration of the strength and the shape of other members.

Further, in the above embodiment, since the first lever 94 and the second lever 93 are separated from each other in the direction of the rotation center axis 90 of the inertia member 9, there is an advantage that the degree of freedom in providing the first lever 94, the second lever 93, the first contact portion 31, and the second contact portion 32 is increased, and the strength of the operating member 3 is easily secured even in a case where a distance, in a rotation direction of the inertia member 9, between the first lever 94 and the second lever 93 is small.

Specifically, in a first modification shown in FIGS. 12A and 12B, instead of omitting the bridge portion 55 of the lock member 5, a bar portion 40 having a length extending over both first levers 94 of the inertia member 9 is integrally provided on a lower surface of the bulge portion 44 of the release button 4. A rear end portion of the bar portion 40 configures the first contact portion 31 of the operating member 3, and a front end portion of the bulge portion 44 configures the second contact portion 32 of the operating member 3, and thus the operating member 3 includes only the release button 4. In this case, in a case where the first inertial force FA in the A direction acts on the operating member 3, the first pressing force Fb is not applied to the lock member 5 from the first lever 94 of the inertia member 9. However, for example, a biasing force of the spring 12 in a forward direction, which is the B direction, may be set to be larger than an inertial force acting on the lock member 5.

In a second modification shown in FIGS. 13A and 13B, a rear end portion of the bridge portion 55 of the lock member 5 configures the first contact portion 31 of the operating member 3, and a front end portion of the bridge portion 55 configures the second contact portion 32 of the operating member 3, and thus the operating member 3 includes only the lock member 5.

In the above embodiment, although the first angle θ1 is smaller than the second angle θ2, the first pressing force Fb is set to be larger than the second pressing force Fa by appropriately setting the first distance L1 to be smaller than the second distance L2. However, as in the second modification shown in FIGS. 13A and 13B, the first pressing force Fb may be set to be larger than the second pressing force Fa by setting the first angle θ1 and the second angle θ2 to the same angle (here, 90°) and setting the first distance L1 to be smaller than the second distance L2.

Figure 14A:
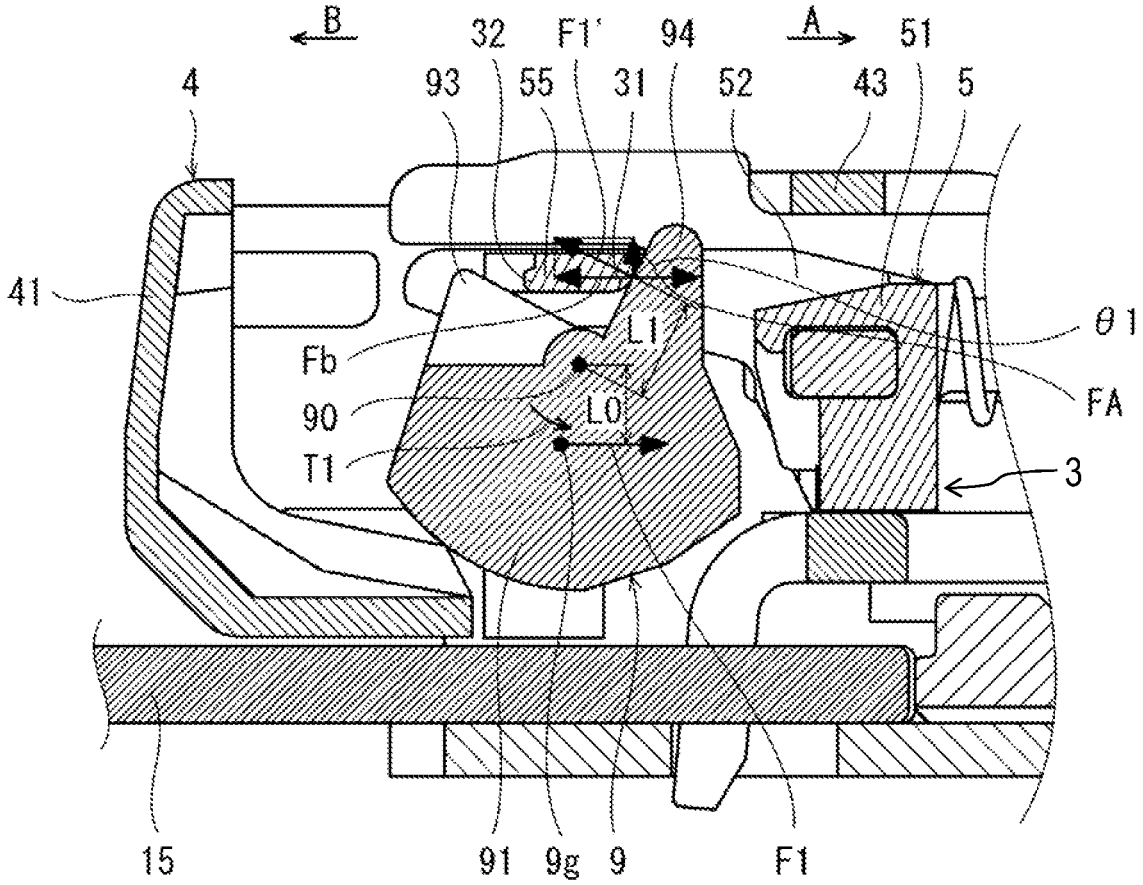
FIG. 14A is a cross-sectional view of a mechanical assembly of a buckle device according to a third modification at a position traversing a first lever and a second lever in an engaged state of the tongue plate, in a case where a first inertial force in an insertion direction of the tongue plate acts on an operating member.
Figure 14B:
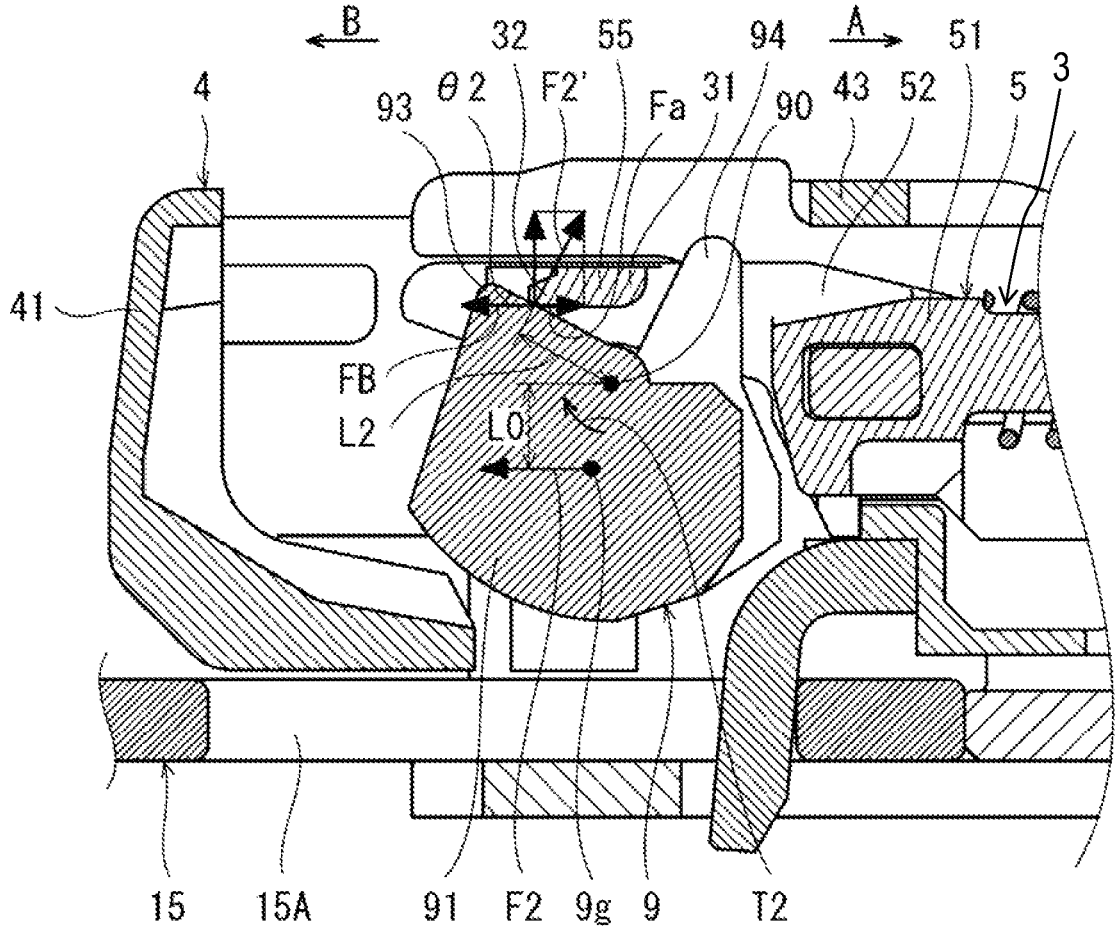
FIG. 14B is a cross-sectional view of a mechanical assembly of a buckle device according to a third modification at a position traversing a first lever and a second lever in an engaged state of the tongue plate, in a case where a second inertial force in a direction opposite to the insertion direction of the tongue plate acts on the operating member.
Figure 15A:
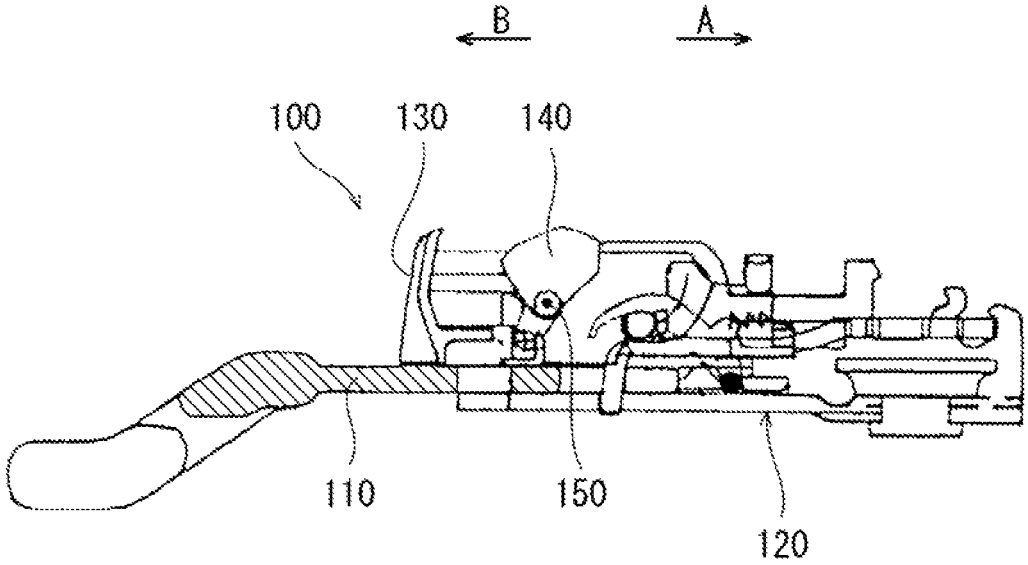
FIG. 15A is a cross-sectional view of a buckle device in the related art.
Figure 15B:
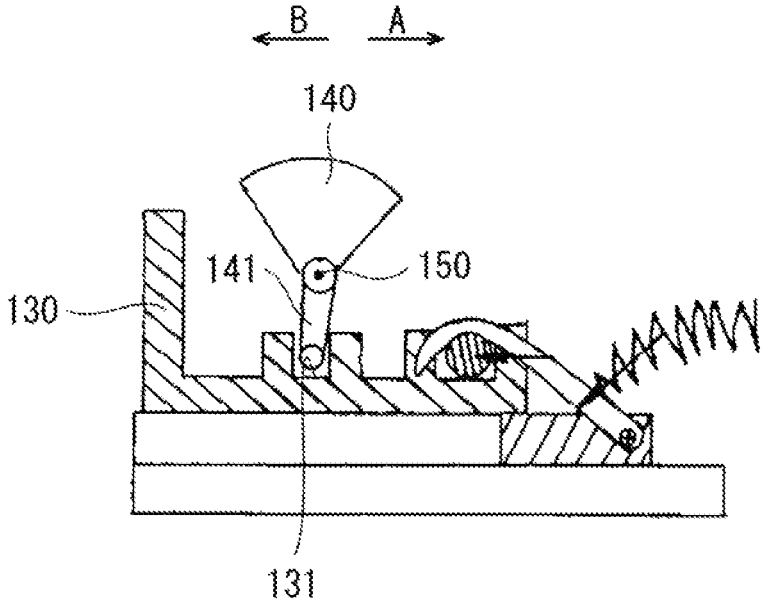
FIG. 15B schematically shows a portion of the buckle device in the related art.

In a third modification shown in FIGS. 14A and 14B, as in the second modification, the operating member 3 includes only the lock member 5. However, in the third modification, although the first distance L1 and the second distance L2 are the same, the first pressing force Fb may be set to be larger than the second pressing force Fa by setting the first angle θ1 to be larger than the second angle θ2.

Further, instead of providing a surface having the first angle θ1 on the first lever 94 and a surface having the second angle θ2 on the second lever 93, a surface facing the first lever 94 and inclined with respect to the acting direction, which is the A direction, of the first inertial force FA may be provided on the first contact portion 31 of the operating member 3, and the first lever 94 may come in contact with the surface. Similarly, a surface facing the second lever 93 and inclined with respect to the acting direction, which is the B direction, of the second inertial force FB may be provided on the second contact portion 32 of the operating member 3, and the second lever 93 may come in contact with the surface. Even in this case, the first pressing force Fb can be set to be larger than the second pressing force Fa by, for example, setting an angle of the surface on the first contact portion 31 to be larger than the angle of the surface on the second contact portion 32 in a range of 90° or less, or by setting the first distance L1 to be smaller than the second distance L2.

In the above embodiment, the lock member 5 is configured to slide in the front-rear direction between the lock position and a non-lock position, but the lock member 5 may be configured to pivot between the lock position and the non-lock position.

In contrast to the above embodiment, the center of gravity 9*g* of the inertia member 9 may be located above the rotation center axis 90. As in the above embodiment, in a case where the center of gravity 9*g* of the inertia member 9 is located below the rotation center axis 90, in other words, in a case where the first lever 94 and the second lever 93 are located on a side opposite to the tongue plate 15 with respect to the rotation center axis 90 in the engaged state of the tongue plate 15, the shapes and sizes of the first lever 94, the second lever 93, the first contact portion 31, and the second contact portion 32 are less likely to be restricted by a space of the tongue plate 15.

What is claimed is:

1. A buckle device into which a tongue plate provided on a seat belt of a vehicle is to be inserted, and for detachably engaging with the inserted tongue plate, the buckle device comprising:

a hollow buckle body;

an operating member configured to be operated in response to a release operation for releasing engagement between the tongue plate and the buckle device, the operating member being supported, in the buckle body, to be slidable in an insertion direction of the tongue plate; and an inertia member supported, in the buckle body, to be rotatable about a rotation center axis extending in a width direction of the tongue plate, wherein the inertia member includes:

a main body portion through which the rotation center axis penetrates; and a first lever and a second lever protruding from the main body portion in a direction away from the rotation center axis, the first lever and the second lever being arranged at a predetermined interval in the insertion direction of the tongue plate when viewed from an extending direction of the rotation center axis, the first lever is located on an inner side, than the second lever, of the buckle body in the insertion direction of the tongue plate, in an engaged state of the tongue plate, the operating member is configured to be in contact, at a first contact portion, with the first lever and configured to be in contact, at a second contact portion, with the second lever, the engaged state of the tongue plate being a state where the tongue plate is engaged with the buckle body, in the engaged state of the tongue plate, the first contact portion and the second contact portion are located between the first lever and the second lever in the insertion direction of the tongue plate, in a case where the tongue plate is disengaged from the buckle body, the first contact portion and the second contact portion move in a direction away from a position between the first lever and the second lever, in accordance with a rotation of the inertia member, in a case where a first inertial force in the insertion direction of the tongue plate acts on the operating member in the engaged state of the tongue plate, the first lever applies, to the first contact portion, a first pressing force in a direction opposite to the insertion direction of the tongue plate, the first pressing force being larger than the first inertial force, and in a case where a second inertial force in the direction opposite to the insertion direction of the tongue plate acts on the operating member in the engaged state of the tongue plate, the second lever applies, to the second contact portion, a second pressing force in the insertion direction of the tongue plate, the second pressing force being smaller than the second inertial force.

2. The buckle device according to claim 1, wherein, in a thickness direction of the tongue plate, a first distance is smaller than a second distance, the first distance being a distance from the rotation center axis of the inertia member to a contact point between the first contact portion and the first lever, the second distance being a distance from the rotation center axis of the inertia member to a contact point between the second contact portion and the second lever.

3. The buckle device according to claim 1, wherein, in the engaged state of the tongue plate, a first angle is larger than a second angle, the first angle being formed by the insertion direction of the tongue plate and a surface, which is at a side of the first contact portion, of the first lever, the second angle being formed by the direction opposite to the insertion direction of the tongue plate and a surface, which is at a side of the second contact portion, of the second lever.

4. The buckle device according to claim 1, further comprising:

a release button configured to receive the release operation;

an engagement member configured to engage with the tongue plate that is to be inserted into the buckle body; and a lock member, wherein, in a case where the engagement member engages with the tongue plate, the lock member is configured to be operated in a lock direction to prevent engagement between the engagement member and the tongue plate from being released, in a case where the release button is operated toward an inner side of the buckle body, the lock member is configured to be operated in a direction opposite to the lock direction to enable the engagement between the engagement member and the tongue plate to be released, and the operating member is at least one of the release button or the lock member.

5. The buckle device according to claim 4, wherein the operating member is both the release button and the lock member, the first contact portion is provided on the lock member, and the second contact portion is provided on the release button.

6. The buckle device according to claim 5, wherein the release button is biased in the direction opposite to the insertion direction of the tongue plate, and in a state where the tongue plate is not inserted into the buckle body, the first lever is configured to be in contact with the lock member, and the second lever is configured to be in contact with the release button.

7. The buckle device according to claim 1, wherein, in the engaged state of the tongue plate, the first lever and the second lever are located on a side opposite to the tongue plate with respect to the rotation center axis.

* * * * *